US010859943B2

(12) United States Patent
Kobayashi et al.

(10) Patent No.: US 10,859,943 B2
(45) Date of Patent: Dec. 8, 2020

(54) CONTAINER MOUNTING STRUCTURE, IMAGE FORMING UNIT, AND IMAGE FORMING APPARATUS

(71) Applicant: FUJI XEROX CO., LTD., Tokyo (JP)

(72) Inventors: Akihiro Kobayashi, Kanagawa (JP); Takuji Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/395,241

(22) Filed: Apr. 26, 2019

(65) Prior Publication Data

US 2020/0192273 A1 Jun. 18, 2020

(30) Foreign Application Priority Data

Dec. 18, 2018 (JP) ..... 2018-236592

(51) Int. Cl.
*G03G 15/08* (2006.01)
*G03G 21/16* (2006.01)

(52) U.S. Cl.
CPC ..... *G03G 15/0867* (2013.01); *G03G 15/087* (2013.01); *G03G 15/0872* (2013.01); *G03G 21/1647* (2013.01); *G03G 21/1676* (2013.01); *G03G 15/0877* (2013.01); *G03G 15/0886* (2013.01)

(58) Field of Classification Search
CPC ..... G03G 15/0867; G03G 15/087; G03G 15/0872; G03G 15/0877; G03G 15/0886; G03G 21/1647; G03G 21/1676
See application file for complete search history.

(56) References Cited

U.S. PATENT DOCUMENTS

| | | | | |
|---|---|---|---|---|
| 7,558,515 | B2 | 7/2009 | Kurita et al. | |
| 2009/0092415 | A1* | 4/2009 | Murakami | G03G 15/0872 399/119 |
| 2012/0134717 | A1* | 5/2012 | Nagashima | G03G 15/087 399/262 |
| 2016/0004185 | A1* | 1/2016 | Enokuchi | G03G 15/0867 399/262 |

FOREIGN PATENT DOCUMENTS

| | | |
|---|---|---|
| JP | 2006208574 | 8/2006 |

* cited by examiner

*Primary Examiner* — Joseph S Wong
(74) *Attorney, Agent, or Firm* — JCIPRNET

(57) ABSTRACT

A container mounting structure includes a container, a container mounting portion, and a regulating section. The container has an opening, extends in one direction, and contains powder. When the container disposed at a predetermined temporarily placed position is rotated in a circumferential direction of the container, the container is mounted to the container mounting portion and the opening of the container is, with the container mounting portion, caused to be exposed. The regulating section regulates the rotation of the container in the circumferential direction in a case where the container is disposed at a position deviated from the temporarily placed position.

12 Claims, 31 Drawing Sheets

CONTAINER MOUNTING STRUCTURE, IMAGE FORMING UNIT, AND IMAGE FORMING APPARATUS

CROSS-REFERENCE TO RELATED APPLICATIONS

This application is based on and claims priority under 35 USC 119 from Japanese Patent Application No. 2018-236592 filed Dec. 18, 2018.

BACKGROUND

(i) Technical Field

The present disclosure relates a container mounting structure, an image forming unit, and an image forming apparatus.

(ii) Related Art

A container described in Japanese Unexamined Patent Application Publication No. 2006-208574 is a toner container that includes a bottle body and a cap. The bottle body has a cylindrical shape and includes a helical transport section. When the transport section is rotated, the transport section transports toner contained therein toward a mouth portion. The cap is mounted to the mouth portion of the bottle body, provided with a replenishment port and a gripping portion at its circumferential surface, and rotatable relative to the bottle body. The bottle body and the cap are integrally mounted to and removed from an apparatus by operating the gripping portion. A rib is provided to regulate such that the axis of a part where the cap accommodates the mouth portion and the axis of rotation of the bottle body are not excessively deviated from each other during the mounting or removing operations.

SUMMARY

Examples of the related-art container mounting structure include a container mounting structure in which a container extending in one direction is mounted to a container mounting portion that is open in a direction intersecting the one direction.

In this container mounting structure, the container approaches the container mounting portion in the intersecting direction so as to be disposed at a predetermined temporarily placed position. Then, by rotating the container disposed at the predetermined temporarily placed position in the container circumferential direction, the container is mounted to the container mounting portion.

When the container is rotated in the circumferential direction as described above, an opening/closing member mounted to the container body of the container is moved relative to the container body in the circumferential direction. This causes the opening to be exposed. The opening is formed in the container body so as to allow powder contained in the container to be discharged to the outside.

Here, the opening may be incompletely exposed when the container having approached the container mounting portion in the intersecting direction is disposed at a position deviated from the predetermined temporarily placed position, and in this state, rotated in the circumferential direction.

Aspects of non-limiting embodiments of the present disclosure relate to, in a structure in which a container is mounted to a container mounting portion by rotating the container disposed at a predetermined temporarily placed position in the circumferential direction of the container, suppressing incomplete exposure of an opening compared to the case where the container is rotated in the circumferential direction even when the container is disposed at a position deviated from the temporarily placed position.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a container mounting structure including a container, a container mounting portion, and a regulating section. The container has an opening, extends in one direction, and contains powder. When the container disposed at a predetermined temporarily placed position is rotated in a circumferential direction of the container, the container is mounted to the container mounting portion and the opening of the container is, with the container mounting portion, caused to be exposed. The regulating section regulates the rotation of the container in the circumferential direction in a case where the container is disposed at a position deviated from the temporarily placed position.

BRIEF DESCRIPTION OF THE DRAWINGS

Exemplary embodiments of the present disclosure will be described in detail based on the following figures, wherein.

DETAILED DESCRIPTION

Figure 1:
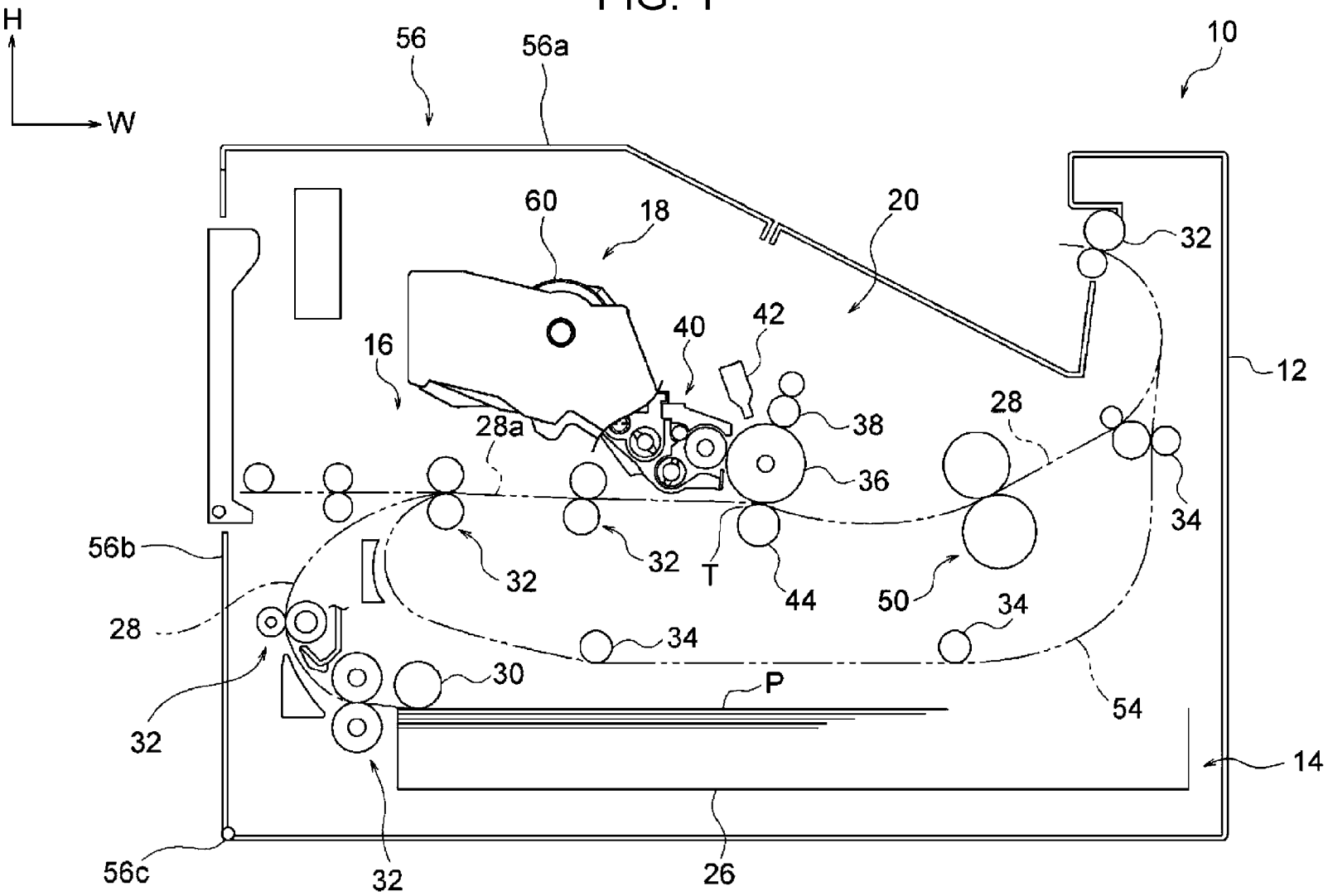
FIG. 1 schematically illustrates the structure of an image forming apparatus according to an exemplary embodiment of the present disclosure.

Examples of a container mounting structure, an image forming unit, and an image forming apparatus according to an exemplary embodiment of the present disclosure are described with reference to FIGS. 1 to 31. An arrow H illustrated in the drawings indicates an apparatus up-down direction (vertical direction), an arrow W illustrated in the drawing indicates an apparatus width direction (horizontal direction), and an arrow D illustrated in the drawings indicates an apparatus depth direction (horizontal direction).

Overall Structure of the Image Forming Apparatus

As illustrated in FIG. 1, an image forming apparatus 10 according to the present exemplary embodiment includes a containing section 14, a transport section 16, and an image forming section 20 disposed in this order from a lower side to an upper side in the up-down direction (arrow H direction). The containing section 14 contains sheet media P. The sheet media P each serve as a recording medium. The transport section 16 transports the sheet media P contained in the containing section 14. The image forming section 20 forms images on the sheet media P transported by the transport section 16 from the containing section 14. The image forming apparatus 10 also includes an apparatus body 12 in which various components of the image forming apparatus 10 are disposed.

The Containing Section 14

The containing section 14 includes a containing member 26 able to be drawn frontward in the apparatus depth direction from the apparatus body 12 of the image forming apparatus 10. The sheet media P are loaded in the containing member 26. The containing section 14 also includes a feed roller 30 that feeds each of the sheet media P loaded in the containing member 26 to a transport path 28 included in the transport section 16.

The Transport Section 16

The transport section 16 includes transport rollers 32 and transport rollers 34. The transport rollers 32 transport the sheet medium P along the predetermined transport path 28. The transport rollers 34 transport the sheet medium P along an inversion path 54 through which the sheet medium P passes so as to be inverted.

The Apparatus Body 12

The apparatus body 12 includes an openable door 56. The door 56 allows, when opened, the inside of the apparatus body 12 to be exposed to the outside of the apparatus body 12. The door 56 has an L shape when seen in the apparatus depth direction and includes a top plate 56*a* and a side plate 56*b*. The top plate 56*a* covers an image forming unit 18 from above. The side plate 56*b* covers the image forming unit 18 from one side (left side in FIG. 1) in the apparatus width direction. The door 56 also includes a rotation shaft 56*c* that is disposed at a lower portion of the side plate 56*b* and extends in the apparatus depth direction.

Figure 2:
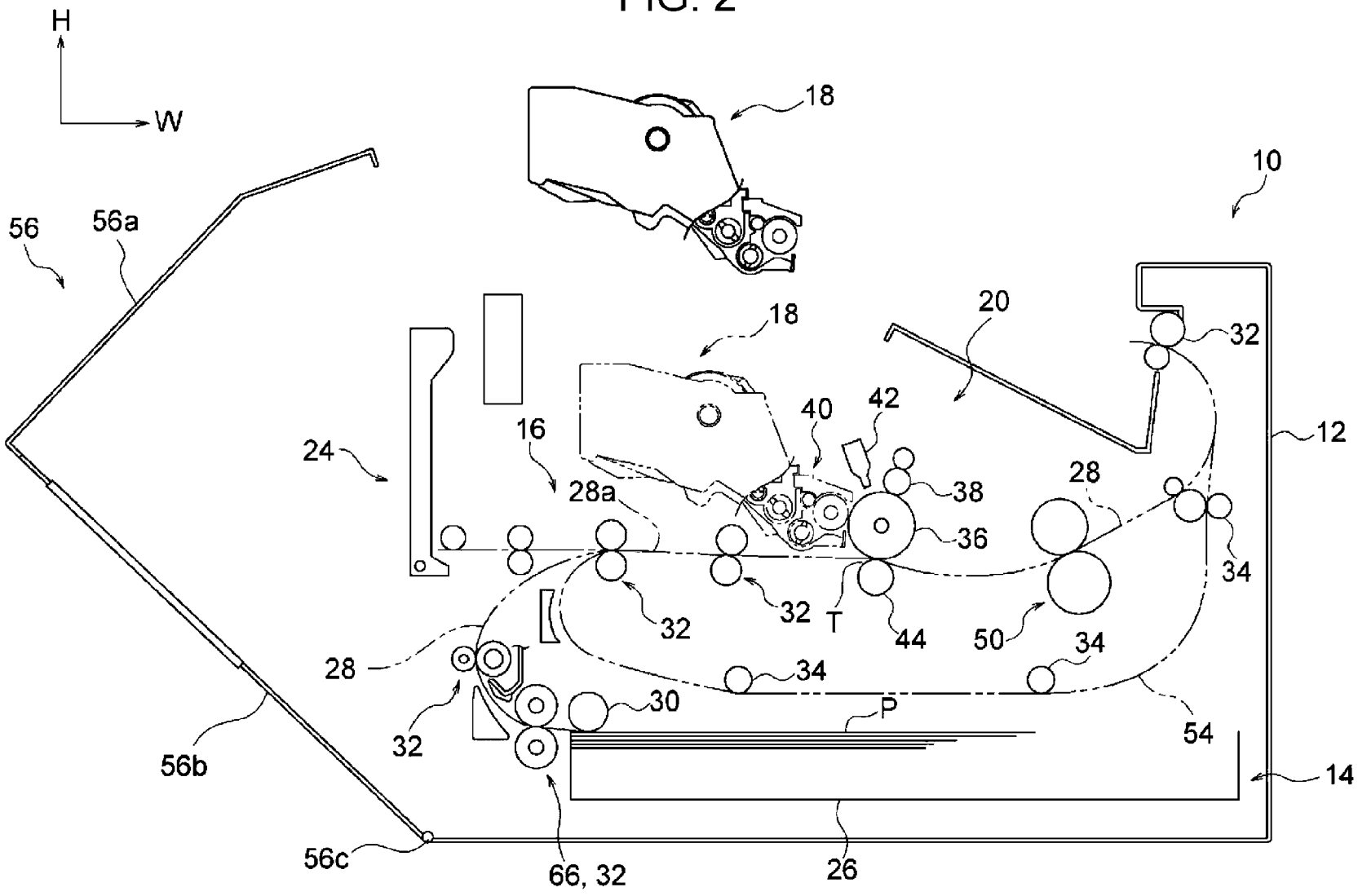
FIG. 2 schematically illustrates the structure of the image forming apparatus according to the exemplary embodiment of the present disclosure.

With the above-described structure, when the door 56 is rotated about the rotation shaft 56*c*, the door is movable to a closed position (see FIG. 1) and an open position (see FIG. 2). When the door 56 is at the closed position, the inside of the apparatus body 12 is blocked. When the door 56 is at the open position, the inside of the apparatus body 12 is exposed. An angle by which the door 56 is rotated is regulated by a stopper (not illustrated).

The Image Forming Section 20

The image forming section 20 includes the image forming unit 18, an image holding body 36, a charging roller 38, and a light exposure device 42. The image forming unit 18 forms a black image. The charging roller 38 charges the surface of the image holding body 36. The light exposure device 42 radiates exposure light to the charged image holding body 36.

The image forming unit 18 includes a developing device 40, a container 60, and so forth. The light exposure device 42 causes the charged image holding body 36 to be exposed to light so as to form an electrostatic latent image. This electrostatic latent image is developed by the developing device 40 with toner as powder so as to be visible as a toner image. The container 60 supplies the toner as the powder to the developing device 40. The developing device 40 is an example of a developing section. The details of the image forming unit 18 will be described later.

The image forming section 20 further includes a transfer roller 44 and a fixing device 50. The transfer roller 44 transfers the toner image formed on the image holding body 36 onto the sheet medium P at a transfer position T. The fixing device 50 applies heat and pressure to the sheet medium P so as to fix the toner image to the sheet medium P.

In the above-described structure, the image forming unit 18 is removable from and mountable to the apparatus body 12 when the door 56 is disposed at the open position (see FIG. 2).

Operations of the Image Forming Apparatus

The image forming apparatus 10 forms an image as follows.

First, the charging roller 38 to which a voltage has been applied is brought into contact with the surface of the image holding body 36 so as to uniformly negatively charge the surface of the image holding body 36 to a predetermined potential. Next, the light exposure device 42, based on data input from the outside, radiates the exposure light to the surface of the charged image holding body 36 so as to form an electrostatic latent image.

Thus, the electrostatic latent image corresponding to the data is formed on the surface of the image holding body 36. Furthermore, the developing device 40 included in the image forming unit 18 develops the electrostatic latent image with the toner as the powder so as to obtain a visible toner image.

The sheet medium P having been fed from the containing member 26 to the transport path 28 by the feed roller 30 is fed to the transfer position T through the transport path 28. At the transfer position T, the sheet medium P is transported while being pinched between the image holding body 36 and the transfer roller 44, thereby the toner image on the surface of the image holding body 36 is transferred onto the sheet medium P.

The toner image having been transferred onto the sheet medium P is fixed to the sheet medium P by the fixing device 50. The sheet medium P to which the toner image has been fixed is output to the outside of the apparatus body 12 by a subset of the transport rollers 32.

Next, the image forming unit 18 is described.

Figure 3:
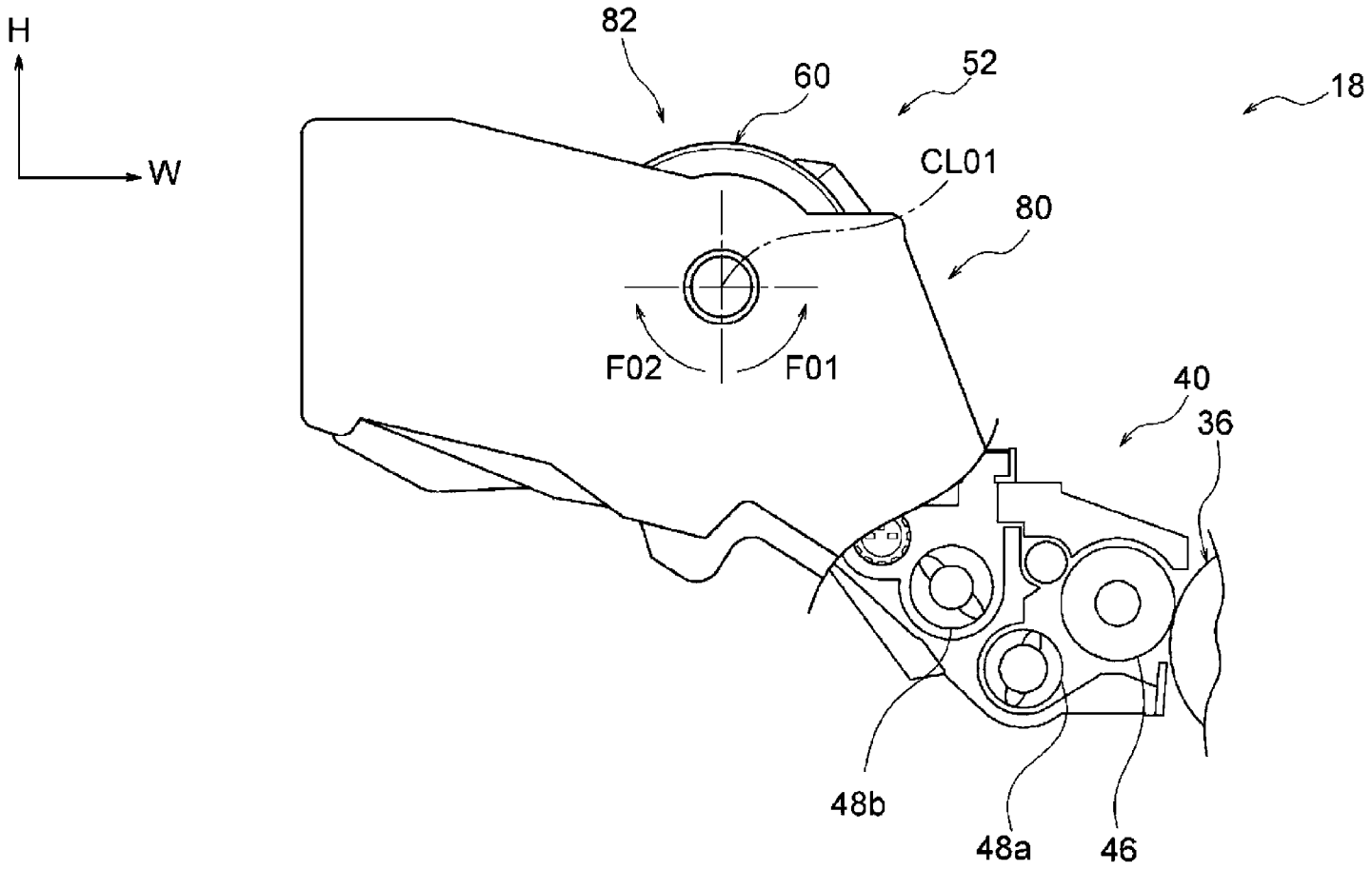
FIG. 3 schematically illustrates the structure of an image forming unit according to the exemplary embodiment of the present disclosure.
Figure 4:
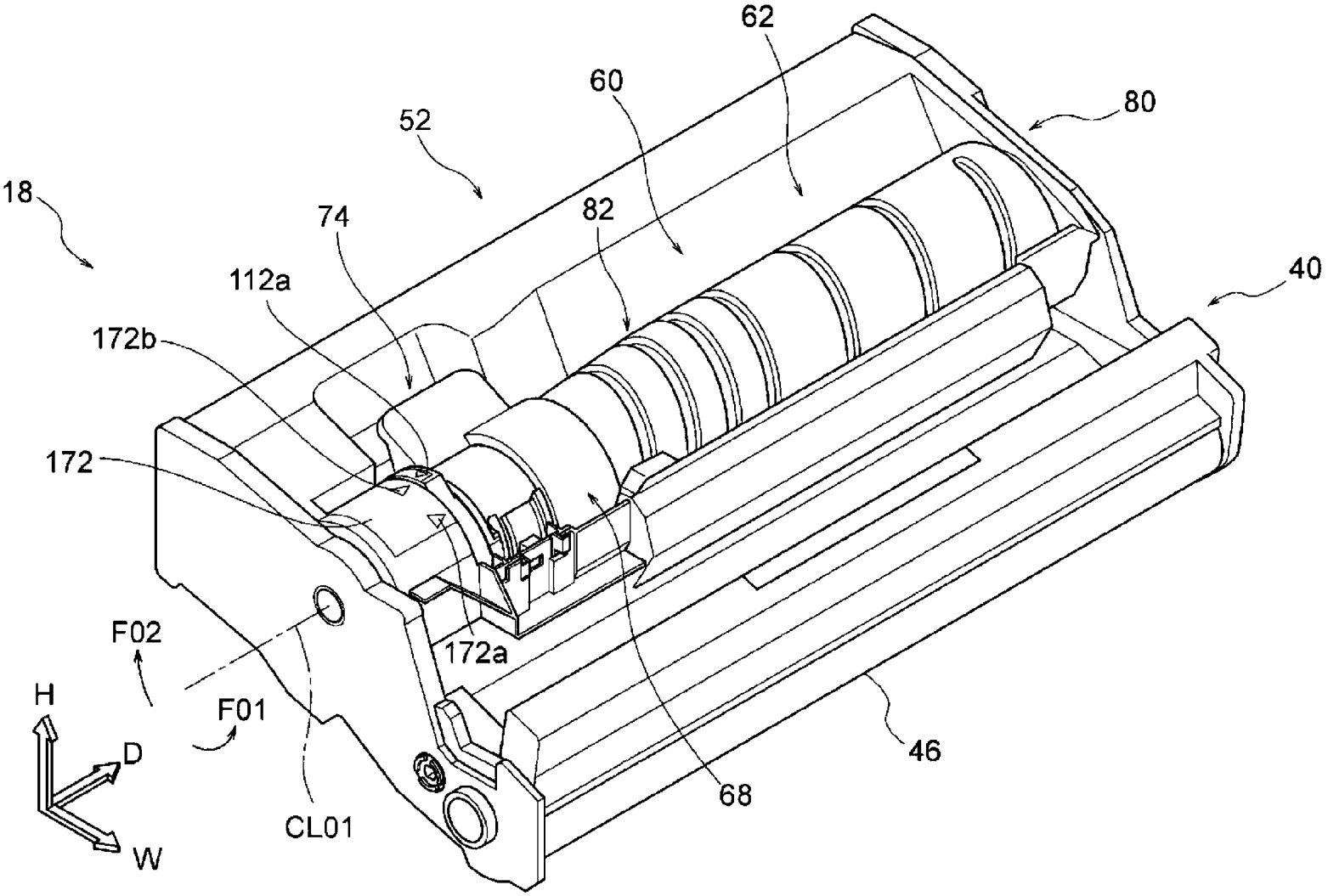
FIG. 4 is a perspective view of a container mounting structure according to the exemplary embodiment of the present disclosure illustrating a state in which a container is disposed at a mounted position.
Figure 6:
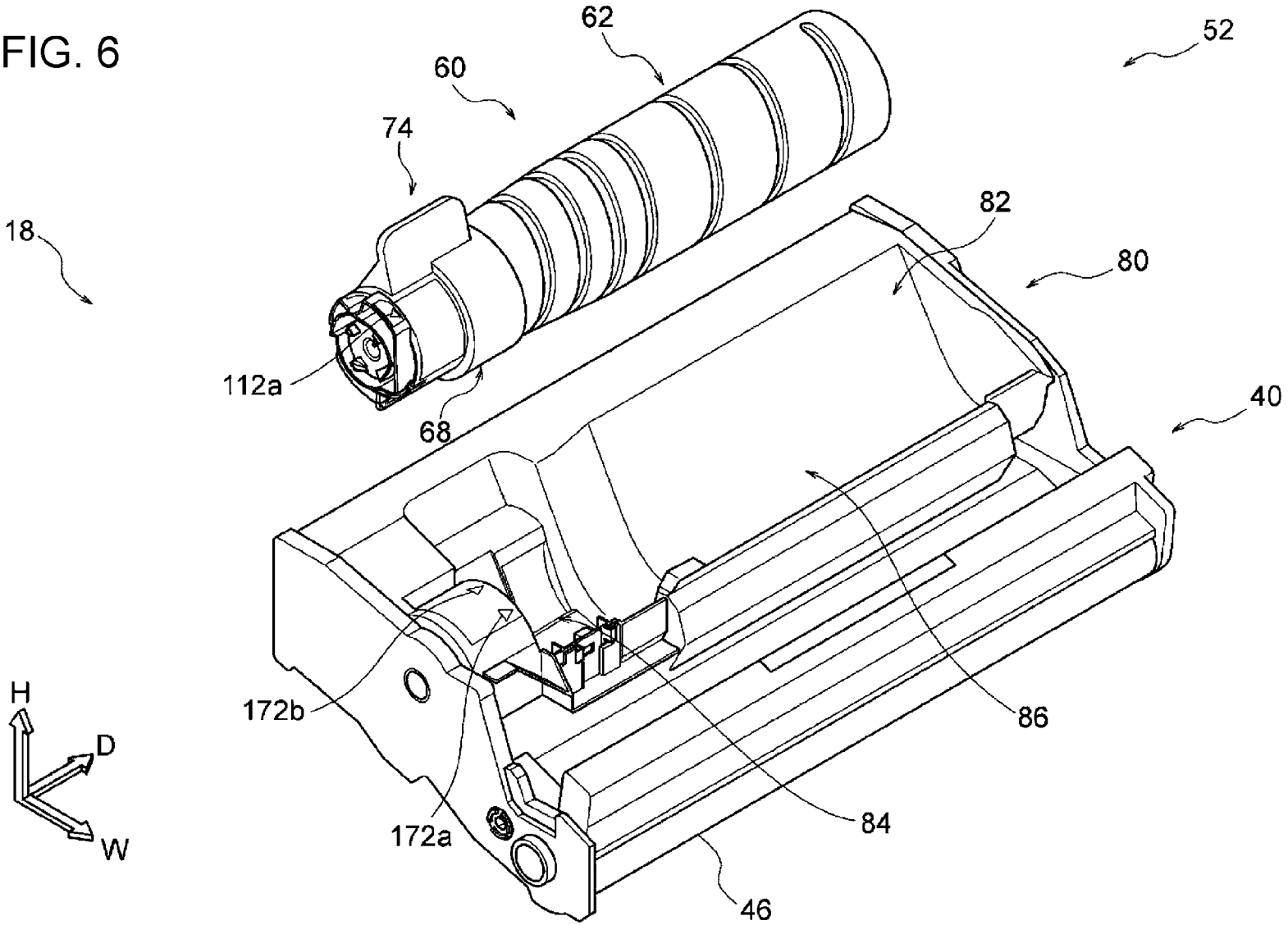
FIG. 6 is a perspective view of the container mounting structure according to the exemplary embodiment of the present disclosure illustrating a state in which the container is removed from a container mounting portion.

As illustrated in FIGS. 3, 4, and 6, the image forming unit 18 includes the developing device 40, the container 60, and a unit body 80. The container 60 contains the toner as the powder to be supplied to the developing device 40. The unit body 80 allows various members to be mounted therein. The unit body 80 has a container mounting portion 82 to which the container 60 is mounted. A container mounting structure 52 includes the container 60 and the container mounting portion 82.

Figure 5:
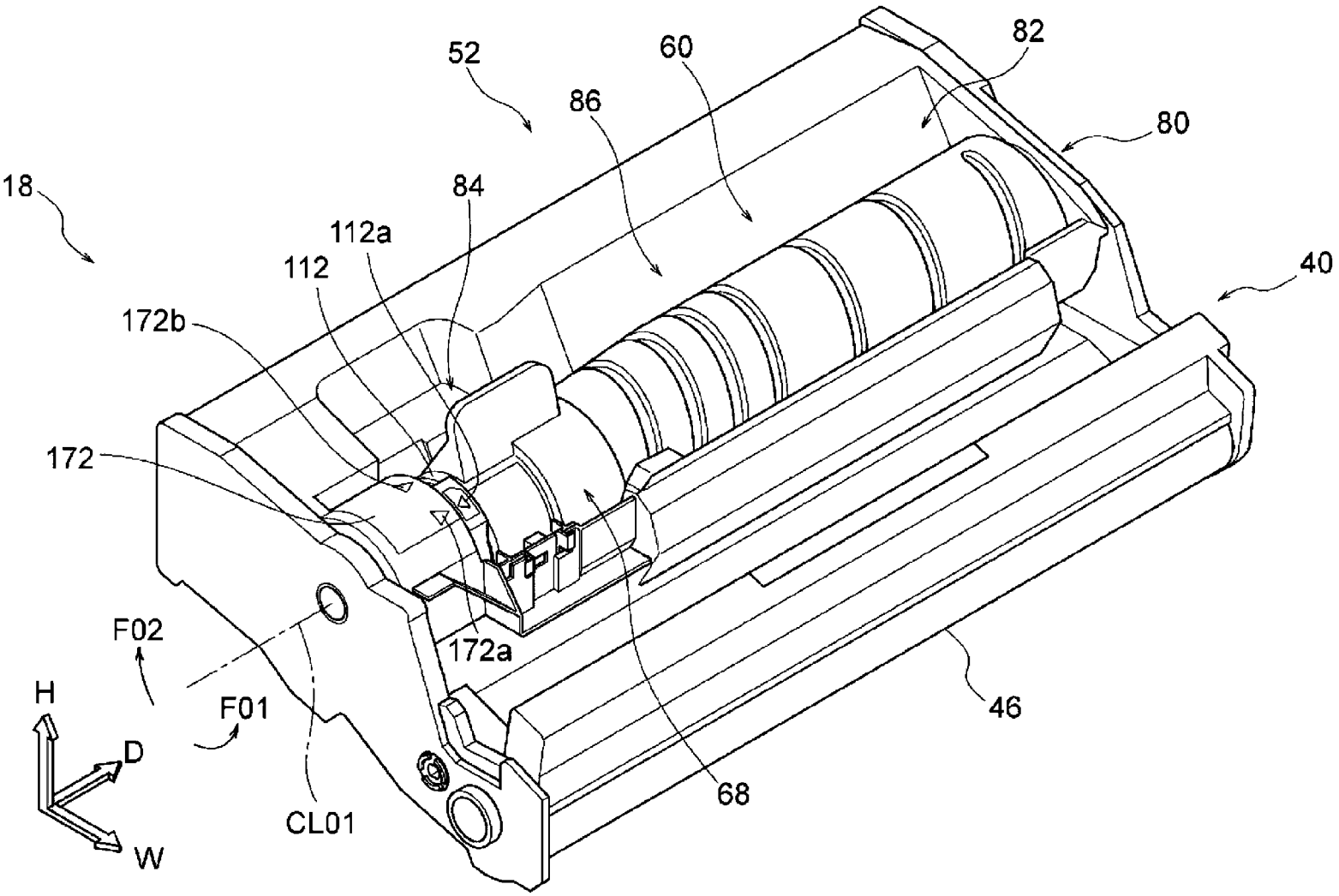
FIG. 5 is a perspective view of the container mounting structure according to the exemplary embodiment of the present disclosure illustrating a state in which the container is disposed at a temporarily placed position.

The container 60 is temporarily placed in the container mounting portion 82 by moving the container 60 downward from above relative to the container mounting portion 82 (in a direction intersecting the apparatus depth direction; see FIG. 5). Thus, the container 60 is disposed at a predetermined temporarily placed position ("temporarily placed position" hereinafter). Furthermore, the container 60 is mounted to the container mounting portion 82 by rotating the container 60 disposed at the temporarily placed position to one side in the circumferential direction of the container 60 (counterclockwise side, that is, an arrow F01 side in, for example, FIG. 4 when seen from the front in the apparatus depth direction; see FIG. 4). In this state, the container 60 is disposed at a mounted position.

The container 60 is removable and mountable when the image forming unit 18 is mounted to the apparatus body 12 and also when the image forming unit 18 is removed from the apparatus body 12.

The Developing Device 40

As illustrated in FIG. 3, the developing device 40 includes a developing roller 46, a supply auger 48*a*, and an agitating auger 48*b*. The developing roller 46 passes the toner as the powder to the electrostatic latent image formed on the image holding body 36. The supply auger 48*a* supplies the toner to the developing roller 46. The agitating auger 48*b* agitates the toner.

The developing roller 46 faces the image holding body 36 in the apparatus width direction. The supply auger 48*a* is disposed at a position on the opposite side to the image holding body 36 with the developing roller 46 interposed therebetween in the apparatus width direction and below the developing roller 46. The agitating auger 48*b* is disposed at a position on the opposite side to the developing roller 46 with the supply auger 48*a* interposed therebetween in the apparatus width direction and above the supply auger 48*a*.

The Container 60

Figure 12:
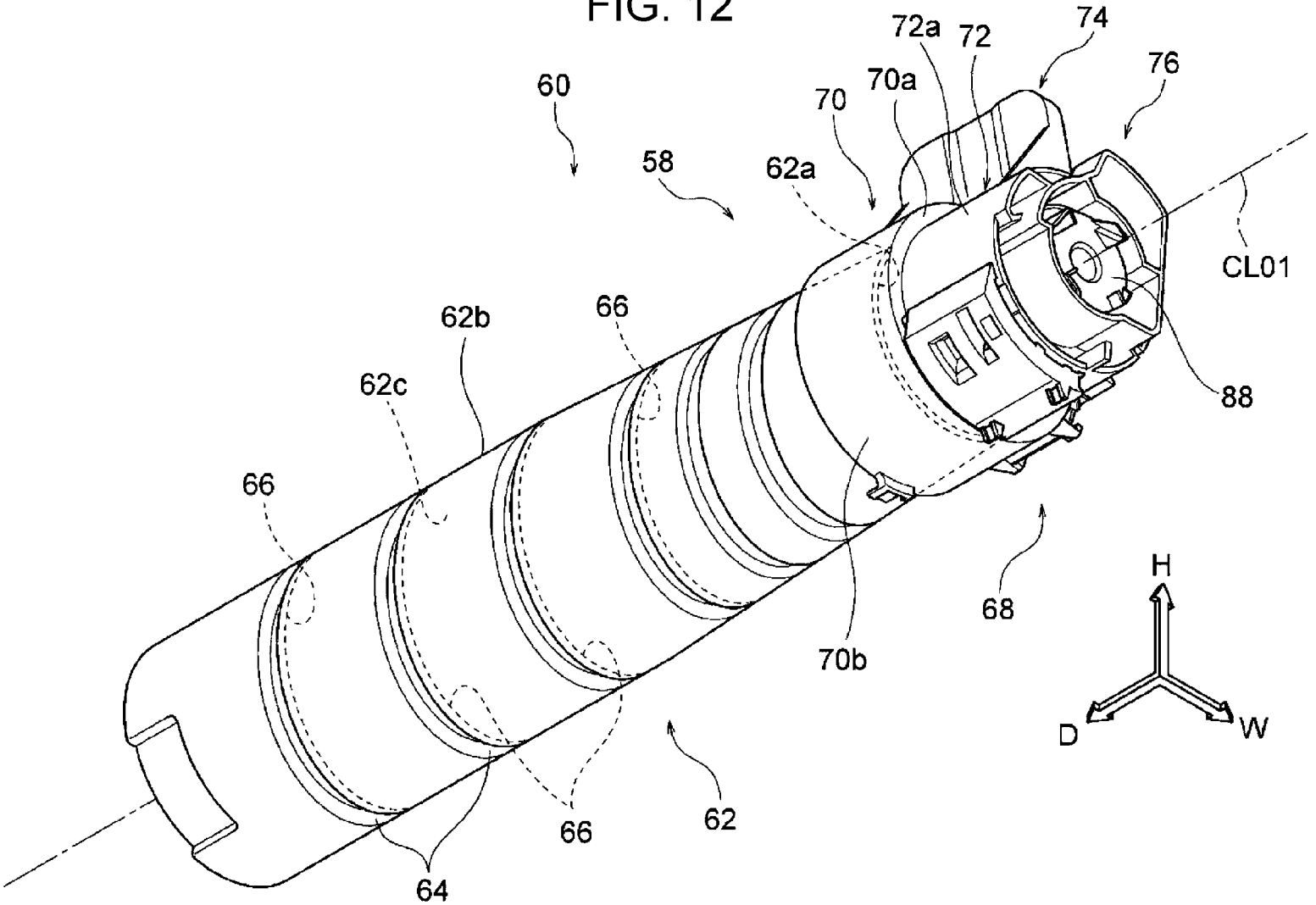
FIG. 12 is a perspective view of the container used for the container mounting structure according to the exemplary embodiment of the present disclosure.
Figure 13:
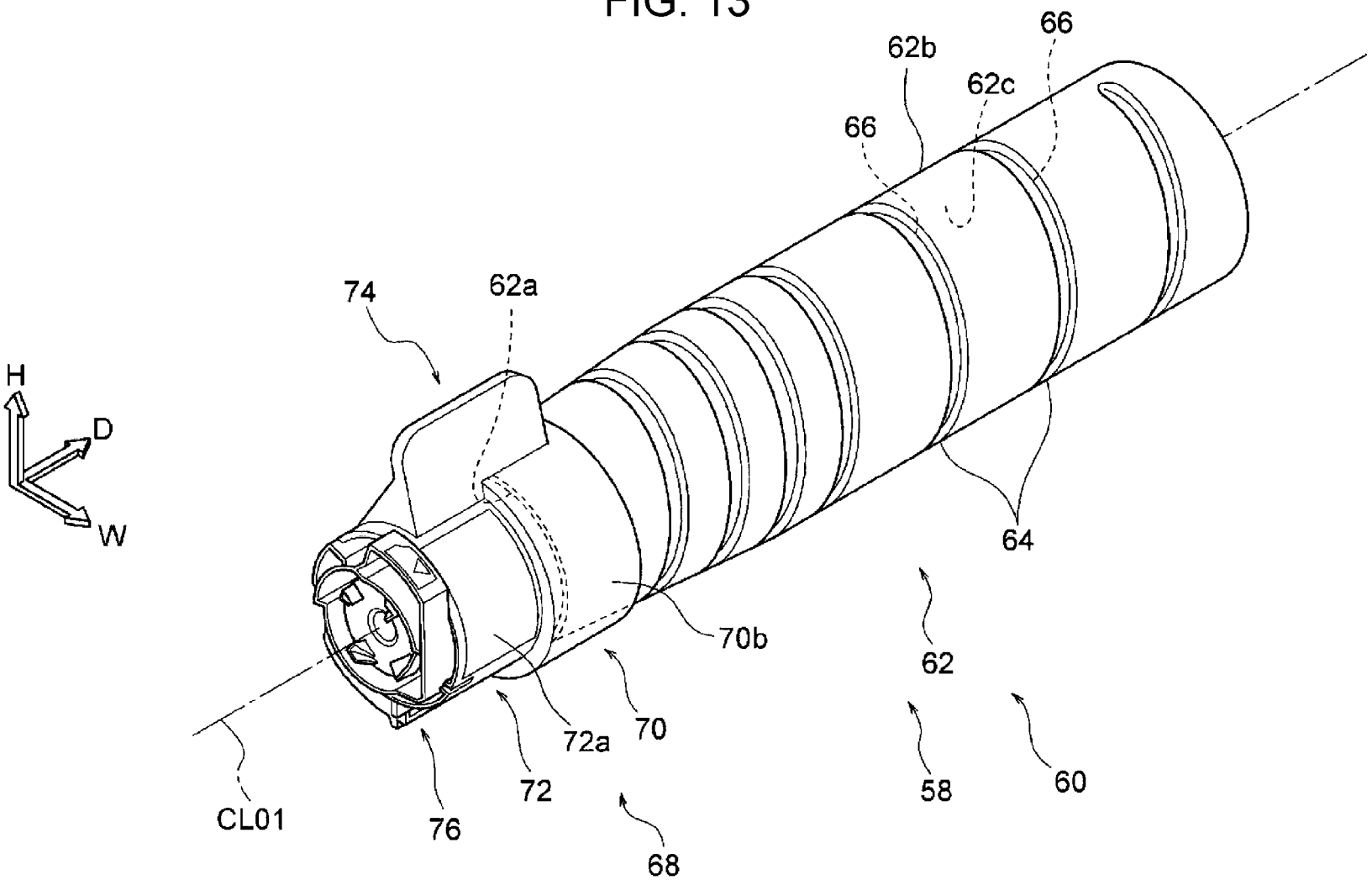
FIG. 13 is a perspective view of the container used for the container mounting structure according to the exemplary embodiment of the present disclosure.

As illustrated in FIG. 3, the container 60 is disposed above the agitating auger 48*b* included in the developing device 40. As illustrated in FIGS. 12 and 13, the container 60 extends in the apparatus depth direction (this apparatus depth direction serves as an example of one direction according to the exemplary embodiment of the disclosure). The container 60 includes a container portion 62 and a lid portion 68. The container portion 62 contains the toner therein. The lid portion 68 is mounted at a front (this front serves as an example of one side according to the exemplary embodiment of the disclosure) part of the container portion 62 in the apparatus depth direction. The container portion 62 and the lid portion 68 are parts of a container body 58. FIGS. 12 and 13 illustrate the container 60 oriented for the disposition at the temporarily placed position in the container mounting portion 82.

Figure 8:
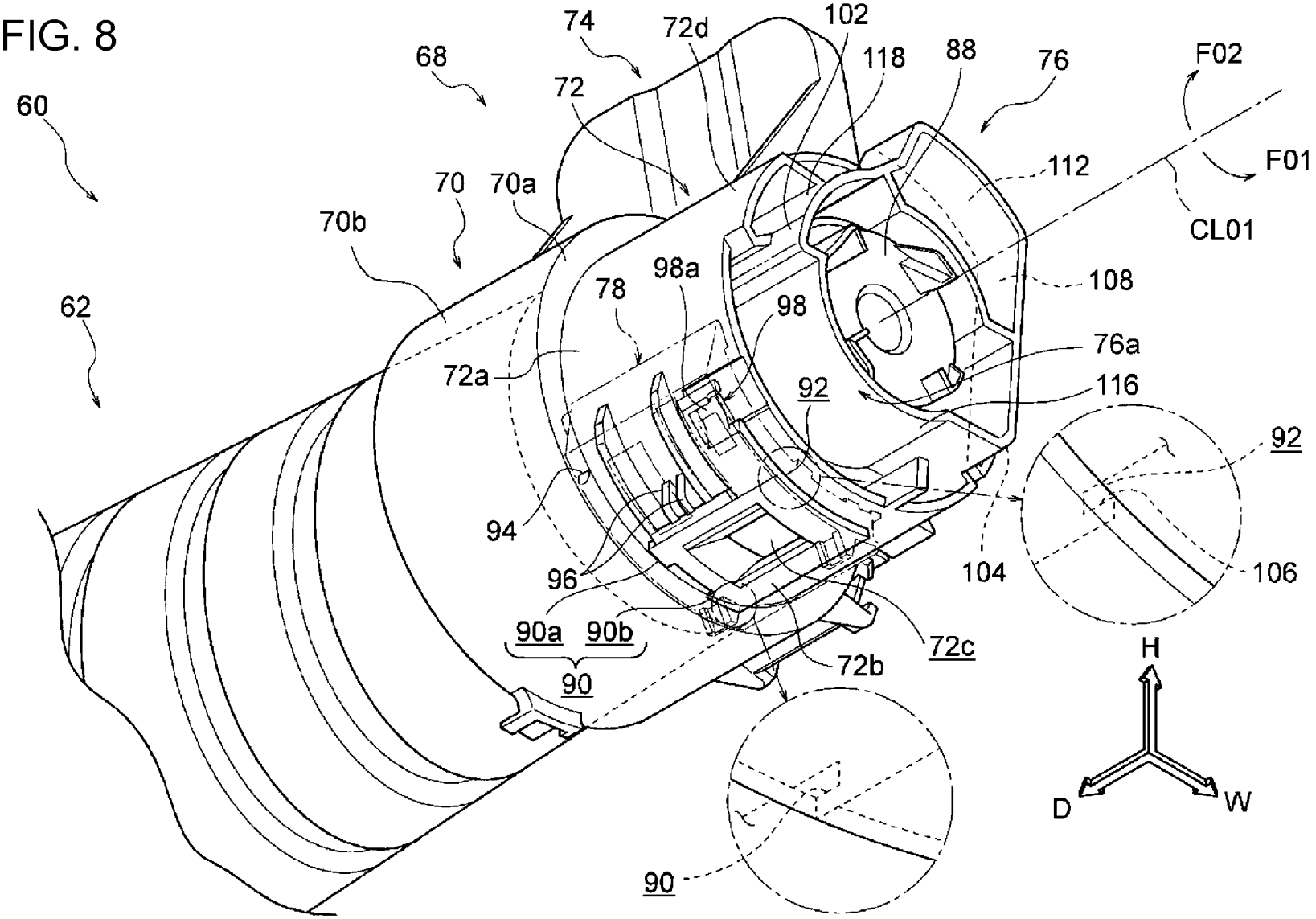
FIG. 8 is an enlarged perspective view of the container used for the container mounting structure according to the exemplary embodiment of the present disclosure.
Figure 9:
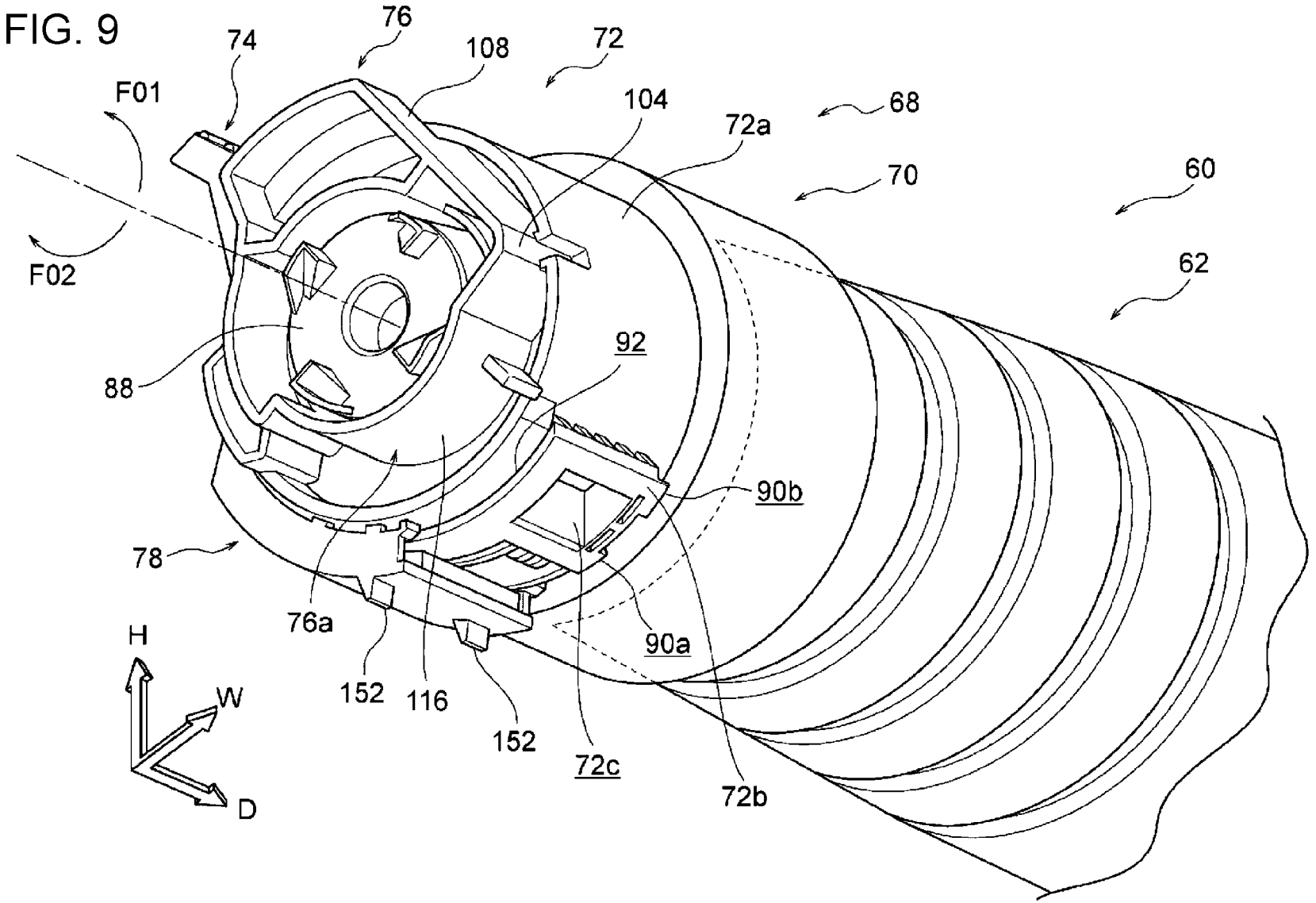
FIG. 9 is an enlarged perspective view of the container used for the container mounting structure according to the exemplary embodiment of the present disclosure.
Figure 10:
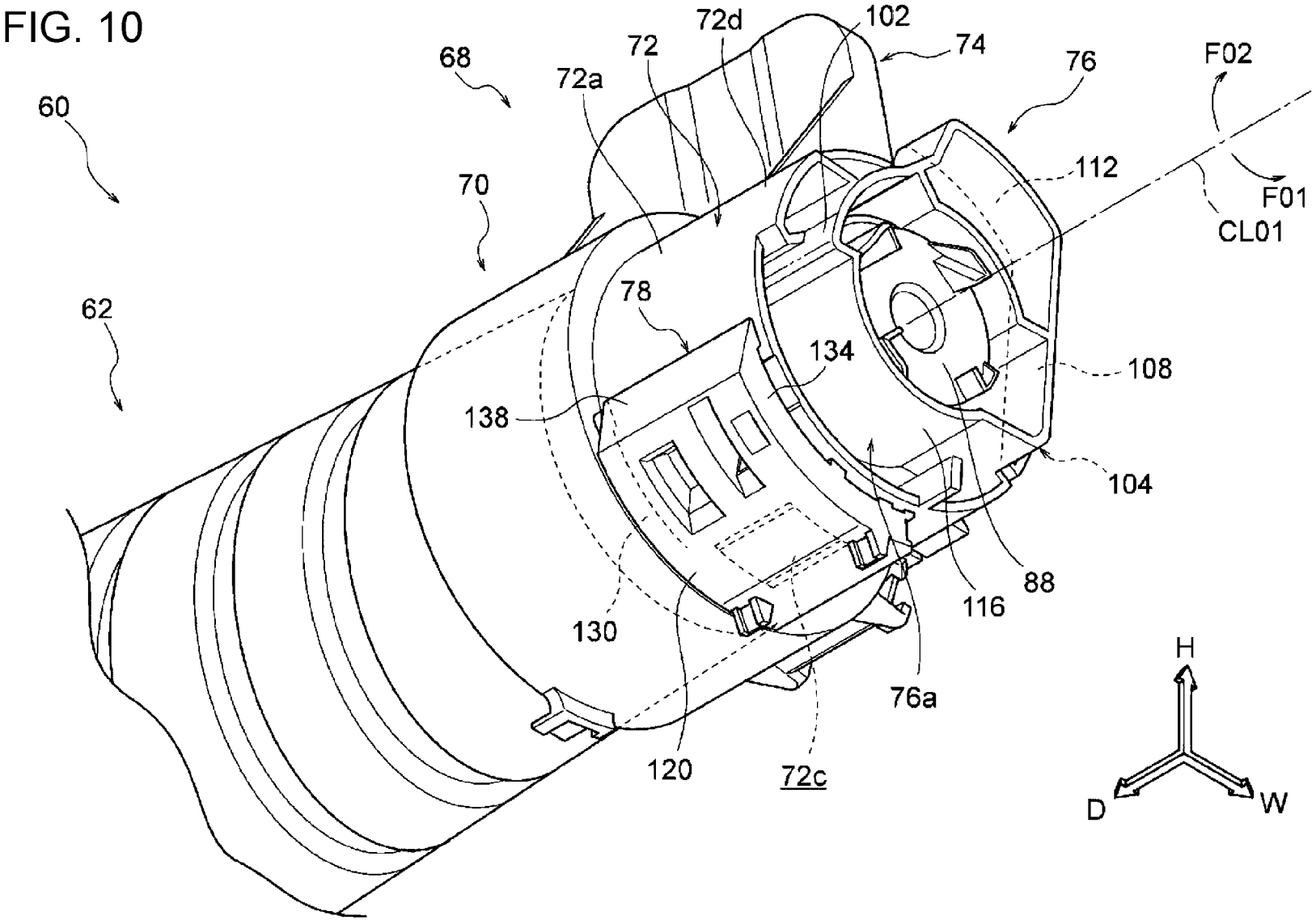
FIG. 10 is an enlarged perspective view of the container used for the container mounting structure according to the exemplary embodiment of the present disclosure.

The lid portion 68 has an opening 72*c* (see FIGS. 8 and 9) through which the toner is discharged to the outside. The container 60 includes an opening/closing member 78 (see FIGS. 9 and 10) that allows the opening 72*c* to be exposed and closes the opening 72*c*. FIGS. 8 and 10 illustrate the container 60 oriented for disposition at the temporarily placed position in the container mounting portion 82. FIG. 9 illustrates the container 60 oriented for disposition at the mounted position in the container mounting portion 82.

The Container Portion 62

The container portion 62 is integrally formed of a resin material. As illustrated in FIGS. 12 and 13, the container portion 62 has a bottle shape extending in the apparatus depth direction and has a mouth portion 62*a* at a front end portion thereof in the apparatus depth direction. A section perpendicular to the longitudinal direction of the container portion 62 has a circular shape centered at a central line CL01 of the container 60. The container portion 62 has a helical groove 64 in an outer circumferential surface 62*b* thereof. The groove 64 forms a helical projection 66 in an inner circumferential surface 62*c* of the container portion 62. The projection 66 projects from the inner circumferential surface 62*c* inward in the container portion 62.

With the above-described structure, the toner contained in the container portion 62 is moved from a rear part to a front part in the apparatus depth direction due to the helical projection 66 by rotating the container portion 62 in the circumferential direction of the container portion 62 ("container circumferential direction" hereinafter). That is, the toner contained in the container portion 62 is moved toward the lid portion 68.

The Lid Portion 68

The lid portion 68 is integrally formed of a resin material. As illustrated in FIGS. 12 and 13, the lid portion 68 is mounted at the front part of the container portion 62 in the apparatus depth direction such that the lid portion 68 is able to be movable relative to the container portion 62 in the container circumferential direction. The lid portion 68 includes a first cylindrical portion 70, a second cylindrical portion 72, a gripping portion 74, and a distal end portion 76. The axis of the first cylindrical portion 70 having a cylindrical shape is coincident with the central line CL01. The axis of the second cylindrical portion 72 having a cylindrical shape is coincident with the central line CL01. The gripping portion 74 is gripped by a user. The first cylindrical portion 70, the second cylindrical portion 72, and the distal end portion 76 are arranged in the apparatus depth direction. The gripping portion 74 projects from the first cylindrical portion 70 and the second cylindrical portion 72.

The First Cylindrical Portion 70 and the Second Cylindrical Portion 72

As illustrated in FIGS. 8 and 10, the first cylindrical portion 70 and the second cylindrical portion 72 are arranged in this order from the rear part to the front part in the apparatus depth direction. The first cylindrical portion 70 has a larger diameter than that of the second cylindrical portion 72. The front part of the container portion 62 in the apparatus depth direction is inserted into the first cylindrical portion 70.

As illustrated in FIG. 8, a step portion 72*b* projecting from an outer circumferential surface 72*a* of the second cylindrical portion 72 is formed on part of the outer circumferential surface 72*a* facing downward. The step portion 72*b* extends in the apparatus depth direction when seen in the radial direction of the container 60 ("container radial direction" hereinafter), and a front part of the step portion 72*b* in the apparatus depth direction extends to another side in the container circumferential direction (toward an arrow F02 side in, for example, FIG. 8). Furthermore, the step portion 72*b* has an arcuate shape centered at the central line CL01 when seen in the apparatus depth direction.

The step portion 72*b* has the opening 72*c* having a rectangular shape extending in the apparatus depth direction. The inside of the container 60 is to be exposed to the outside through the opening 72*c*. The opening 72*c* faces downward when the container 60 is oriented for the disposition at the temporarily placed position.

The second cylindrical portion 72 also has an extended surface 72*d* formed by extending part of the outer circumferential surface 72*a* toward the front in the apparatus depth direction. The extended surface 72*d* is disposed, in the container circumferential direction, at a position on the other side relative to the step portion 72*b* and on the one side relative to the gripping portion 74, which will be described later.

Furthermore, the second cylindrical portion 72 has a pair of guide grooves 90, 92 in the outer circumferential surface 72*a* thereof. The opening/closing member 78 (see FIG. 9) that allows the opening 72*c* to be exposed and closes the opening 72*c* is guided through the guide grooves 90, 92 in the container circumferential direction. The first cylindrical portion 70 has a guide projection 94 through which the opening/closing member 78 is guided in the container circumferential direction.

The guide groove 90 extends in the container circumferential direction in part of the step portion 72*b* near the first cylindrical portion 70 and has a U shape in section which is open at the rear in the apparatus depth direction (opposite to the opening 72*c*). The guide groove 90 is divided into a guide groove 90*a* and a guide groove 90*b* kept separated from each other in the container circumferential direction. The guide groove 90*a* and the guide groove 90*b* are arranged in this order from the other side to the one side (the arrow F01 side in, for example, FIG. 8) in the container circumferential direction.

The guide projection 94 projects from an end surface 70*a* of the first cylindrical portion 70 facing the second cylindrical portion 72 toward the front in the apparatus depth direction. The guide projection 94, the guide groove 90*a*, and the guide groove 90*b* are arranged in this order from the other side to the one side in the container circumferential direction.

The guide groove 92 extends in the container circumferential direction in a portion of the step portion 72*b* opposite to the first cylindrical portion 70 and has a U shape in section which is open at the front in the apparatus depth direction (opposite to the opening 72*c*). The guide groove 92 extends to the other side in the container circumferential direction relative to a range where the guide groove 90*a* and the guide groove 90*b* are formed in the container circumferential direction.

Furthermore, a surface that defines the guide groove 92 and faces inward in the container radial direction is a contact surface 106 that is brought into contact with the container mounting portion 82 so as to position the container 60 relative to the container mounting portion 82 (the details will be described later). This contact surface 106 has an arcuate shape centered at the central line CL01 when seen in the apparatus depth direction.

With the above-described structure, in the apparatus depth direction, the guide projection 94, the guide groove 90*a*, and the guide groove 90*b* are in contact with a rear part of the opening/closing member 78 and the guide groove 92 is in contact with a front part of the opening/closing member 78. The opening/closing member 78 is guided in the container circumferential direction through the guide grooves 90, 92 and the guide projection 94 (see FIGS. 9 and 10).

Furthermore, as illustrated in FIG. 8, the second cylindrical portion 72 has regulating projections 96 at the outer circumferential surface 72*a* thereof. The regulating projections 96 regulate the position of the lid portion 68 of the container 60 disposed at the temporarily placed position. Two regulating projections 96 are provided. The regulating projections 96 project from a portion of the step portion 72*b* on the other side in the container circumferential direction to the other side in the container circumferential direction.

With this structure, in the state in which the container 60 is disposed at the temporarily placed position, the regulating projections 96 are in contact with a suppressing plate 150, which will be described later, formed in the opening/closing member 78, thereby regulating rotation of the lid portion 68 to the other side in the container circumferential direction (see FIG. 19).

Furthermore, as illustrated in FIG. 8, the second cylindrical portion 72 has a limiting portion 98 at the outer circumferential surface 72*a* thereof. The limiting portion 98 limits a movement of the opening/closing member 78 relative to the lid portion 68. The limiting portion 98 is formed in a portion of the step portion 72*b* extending to the other side in the container circumferential direction. The limiting portion 98 has a cantilever shape having a free end at a portion thereof on the other side in the container circumferential direction. A recess 98*a* open toward the outside in the container radial direction is formed near the free end in the limiting portion 98.

Figure 21:
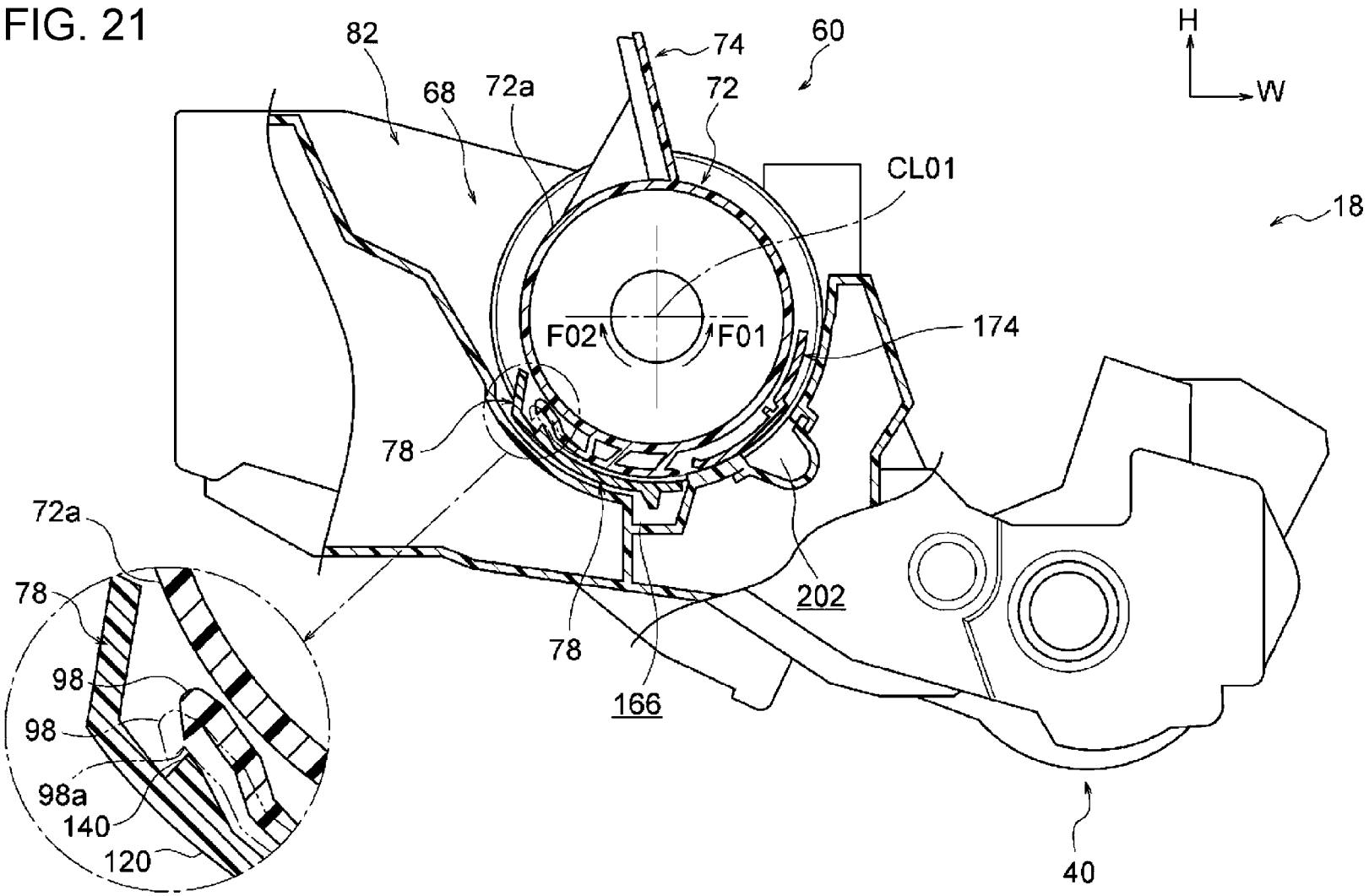
FIG. 21 is a sectional view illustrating the state in which the container is disposed at the temporarily placed position in the container mounting structure according to the exemplary embodiment of the present disclosure.

With this structure, the recess 98*a* is engaged with a protrusion 140, which will be described later, formed in the opening/closing member 78, thereby limiting the movement of the opening/closing member 78 (see a two-dot chain line illustrated in FIG. 21). In other words, the recess 98*a* is engaged with the protrusion 140, which will be described later, formed in the opening/closing member 78, thereby relative movements of the lid portion 68 and the opening/closing member 78 to each other are limited.

The Gripping Portion 74

As illustrated in FIGS. 8 and 10, the gripping portion 74 has a plate shape the plate surface of which faces in the container circumferential direction. The gripping portion 74 projects outward in the container radial direction from the first cylindrical portion 70 and the second cylindrical portion 72. Specifically, when seen in the apparatus depth direction, the gripping portion 74 projects outward in the container radial direction from the opposite side to the opening 72*c* with the first cylindrical portion 70 and the second cylindrical portion 72 interposed therebetween.

The Distal End Portion 76

Figure 11:
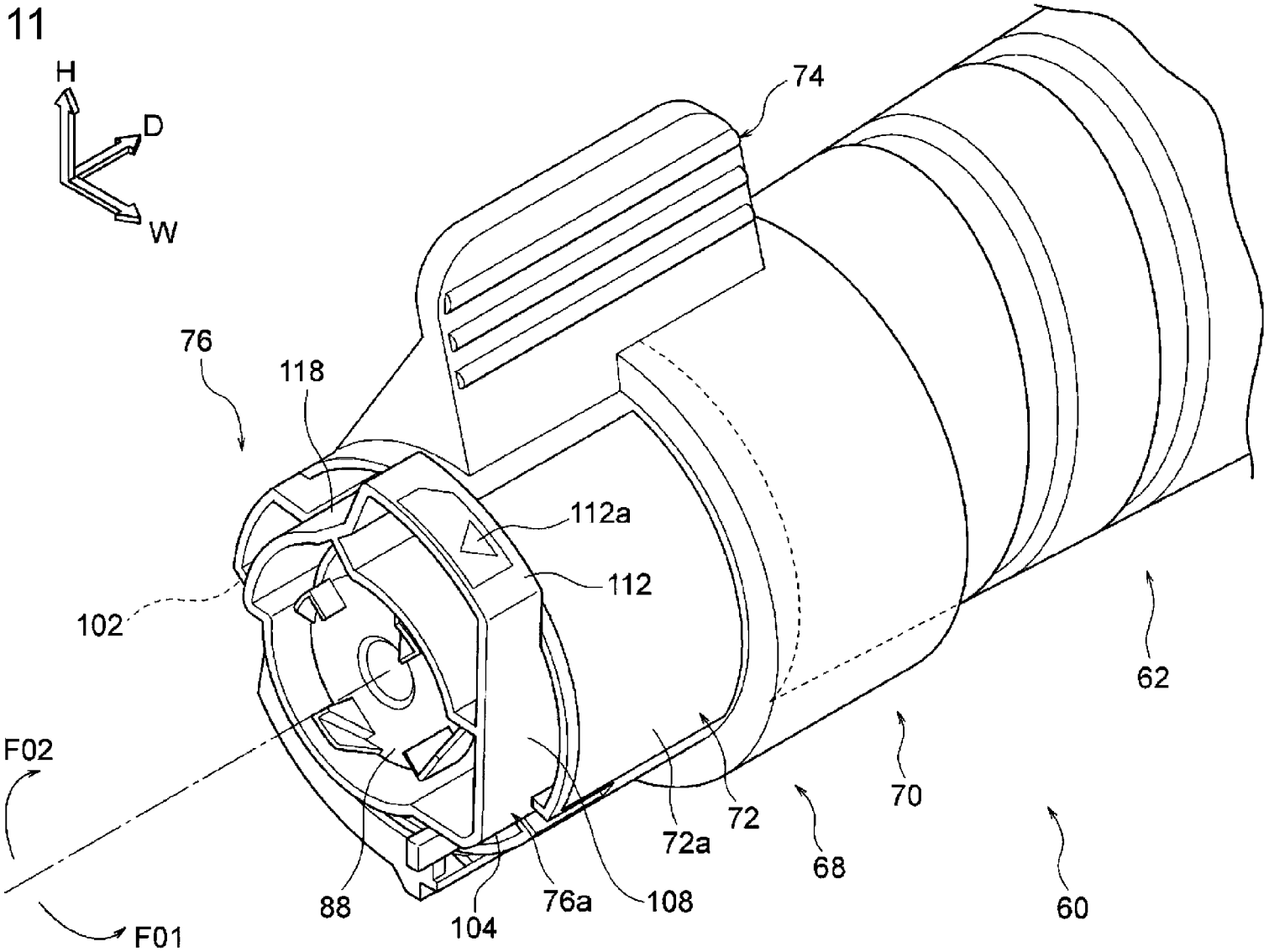
FIG. 11 is an enlarged perspective view of the container used for the container mounting structure according to the exemplary embodiment of the present disclosure.

As illustrated in FIGS. 8, 9, 10, and 11, the distal end portion 76 is formed in front of the second cylindrical portion 72 (opposite to the first cylindrical portion 70) in the apparatus depth direction. The distal end portion 76 has a frame shape which is open at the front in the apparatus depth direction. FIG. 11 illustrates the container 60 oriented for the disposition at the temporarily placed position in the container mounting portion 82.

Contact surfaces 102, 104 that are brought into contact with the container mounting portion 82 are formed in an outer circumferential surface 76*a* of the distal end portion 76 so as to position the container 60 relative to the container mounting portion 82. Furthermore, a guide surface 108 and a marked surface 112 are formed in the outer circumferential surface 76*a*. The guide surface 108 is brought into contact with the container mounting portion 82 so as to dispose the container 60 at the temporarily placed position in the container mounting portion 82 when the container 60 is moved downward from above the container mounting portion 82. The marked surface 112 allows the user to understand the position of the container 60 in the container circumferential direction.

As illustrated in FIG. 8, the contact surface 102 is disposed, in the container circumferential direction, at a position on the other side relative to the step portion 72*b* and on the one side relative to the gripping portion 74. Specifically, in the outer circumferential surface 76*a* of the distal end portion 76, an arcuate surface 116 is formed at a position substantially the same as that of the step portion 72*b* in the container circumferential direction. The diameter of the arcuate surface 116 is smaller than that of the outer circumferential surface 72*a* of the second cylindrical portion 72. Furthermore, the contact surface 102 and an auxiliary surface 118 are formed on the other side relative to the arcuate surface 116 with a step interposed therebetween in the container circumferential direction. The diameters of the contact surface 102 and the auxiliary surface 118 are larger than that of the arcuate surface 116. The contact surface 102 and the auxiliary surface 118 are arranged in this order from the one side to the other side in the container circumferential direction.

The contact surface 102 faces outward in the container radial direction and has a smaller diameter than that of the outer circumferential surface 72*a* of the second cylindrical portion 72. This contact surface 102 has an arcuate shape centered at the central line CL01 when seen in the apparatus depth direction. Furthermore, the diameter of the auxiliary surface 118 is smaller than that of the contact surface 102.

As illustrated in FIG. 9, the contact surface 104 is disposed, in the container circumferential direction, at a position on the one side relative to the step portion 72*b* and on the other side relative to the gripping portion 74. Specifically, the contact surface 104 is formed on the one side relative to the arcuate surface 116 with a step interposed therebetween in the container circumferential direction. The diameter of the contact surface 104 is larger than that of the arcuate surface 116.

The contact surface 104 faces outward in the container radial direction and has a smaller diameter than that of the outer circumferential surface 72*a* of the second cylindrical portion 72. This contact surface 104 has an arcuate shape centered at the central line CL01 when seen in the apparatus depth direction.

Figure 18:
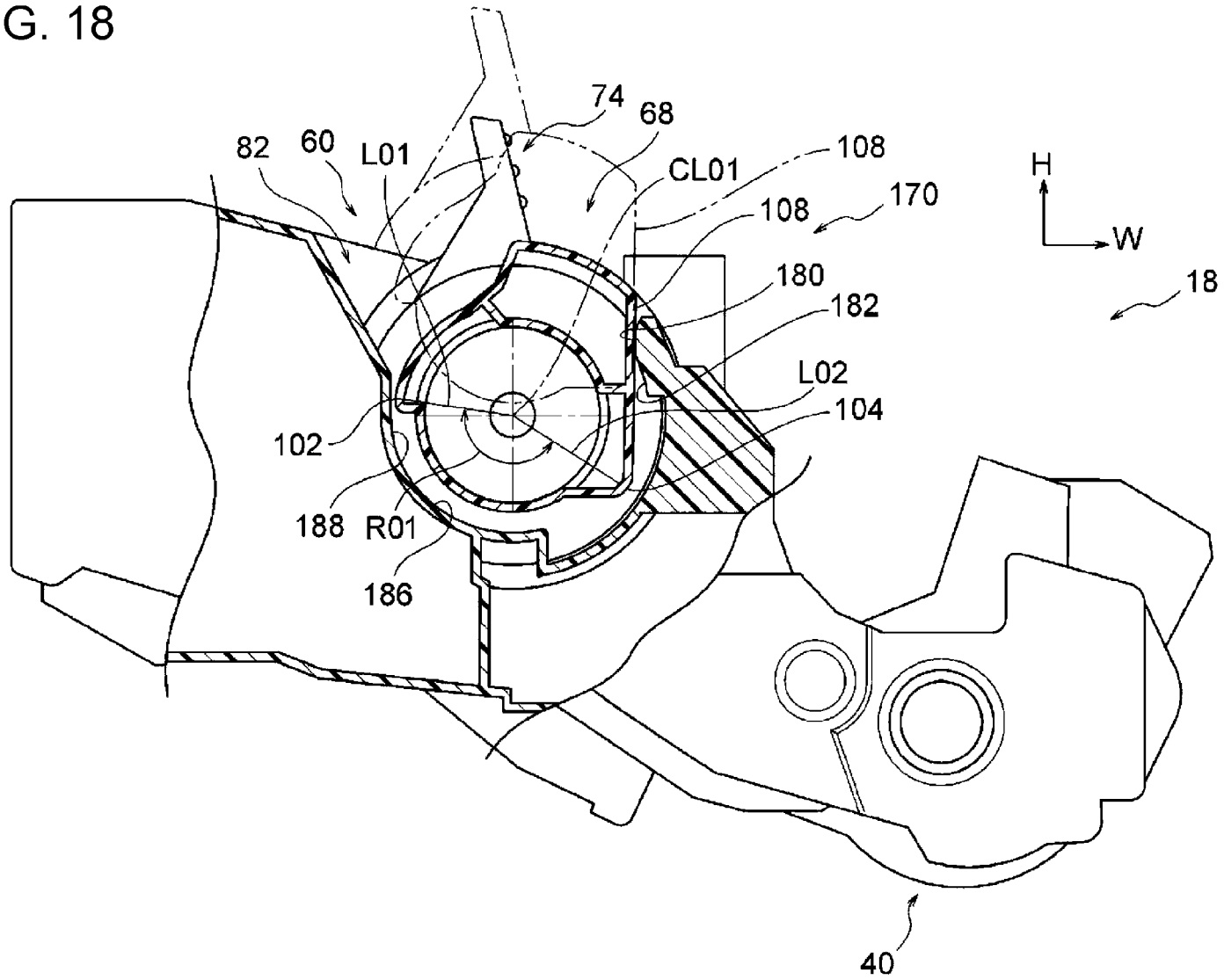
FIG. 18 is a sectional view illustrating the state in which the container is disposed at the temporarily placed position in the container mounting structure according to the exemplary embodiment of the present disclosure.

Furthermore, as illustrated in FIG. 18, when seen in the apparatus depth direction, a line segment L01 connects the central line CL01 and a central portion of the contact surface 102 to each other in the container circumferential direction, and a line segment L02 connects the central line CL01 and a central portion of the contact surface 104 to each other in the container circumferential direction. In this case, an angle R01 formed between the line segment L01 and the line segment L02 is smaller than 180 degrees. FIG. 18 illustrates the container 60 disposed at the temporarily placed position in the container mounting portion 82.

As illustrated in FIGS. 9 and 11, the guide surface 108 is disposed, in the container circumferential direction, at a position on the one side relative to the step portion 72*b* and on the other side relative to the gripping portion 74. Specifically, the guide surface 108 is formed on the one side relative to the contact surface 104 in the container circumferential direction and adjacent to the contact surface 104. The guide surface 108 has a flat shape and, in the state in which the container 60 is disposed at the temporarily placed position, faces the other side in the apparatus width direction and extends in the up-down direction.

As illustrated in FIG. 11, the marked surface 112 is disposed, in the container circumferential direction, at a position on the one side relative to the guide surface 108 and on the other side relative to the auxiliary surface 118. Specifically, the marked surface 112 is formed on the other side relative to the auxiliary surface 118 with a step interposed therebetween in the container circumferential direction. The diameter of the marked surface 112 is larger than that of the outer circumferential surface 72*a* of the second cylindrical portion 72.

Furthermore, the marked surface 112 has an arcuate shape centered at the central line CL01 when seen in the apparatus depth direction. Furthermore, a triangular mark 112*a* the vertex of which points toward the front in the apparatus depth direction is formed on the marked surface 112.

The Opening/Closing Member 78

The opening/closing member 78 is mounted to the lid portion 68 such that the opening/closing member 78 is movable relative to the lid portion 68 in the container circumferential direction. The opening/closing member 78 is moved relative to the lid portion 68 to an open position (see FIG. 9) where the opening/closing member 78 allows the opening 72*c* formed in the lid portion 68 to be exposed and a closed position (see FIG. 10) where the opening/closing member 78 closes the opening 72*c*.

As illustrated in FIG. 10, the opening/closing member 78 is mounted to the outer circumferential surface 72*a* of the second cylindrical portion 72 of the lid portion 68 and has a rectangular shape extending in the container circumferential direction when seen from the outside in the container radial direction.

The opening/closing member 78 has a curved plate 120 and a side plate 130. The curved plate 120 extends along the outer circumferential surface 72*a* while being kept separated, in the container radial direction, from the outer circumferential surface 72*a*. The side plate 130 projects from an edge portion of the curved plate 120 near the first cylindrical portion 70 toward the outer circumferential surface 72*a* and extends in the container circumferential direction. Furthermore, the opening/closing member 78 has a side plate 134 and a side plate 138. The side plate 134 projects from an edge portion of the curved plate 120 opposite to the first cylindrical portion 70 toward the outer circumferential surface 72*a* and extends in the container circumferential direction. The side plate 138 projects from an edge portion of the curved plate 120 on the other side in the container circumferential direction toward the outer circumferential surface 72*a* and extends in the apparatus depth direction. The side plates 130, 134, 138 in combination form a U shape when seen from the outside in the container radial direction. The side plate 138 is an example of an edge portion.

The Side Plate 130

Figure 14B:
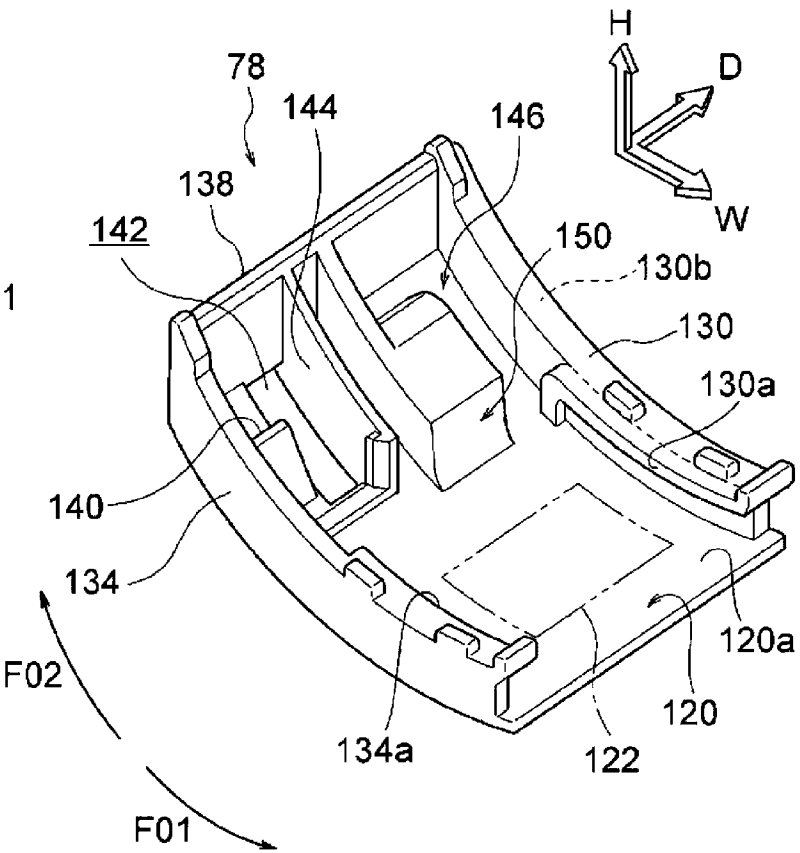
FIGS. 14A and 14B are perspective views of an opening/closing member mounted to the container used for the container mounting structure according to the exemplary embodiment of the present disclosure.

As illustrated in FIG. 14B, a projecting portion 130*a* is formed at a distal end portion of the side plate 130. The projecting portion 130*a* projects toward the side plate 134 and extends in the container circumferential direction. This projecting portion 130*a* is inserted into the guide grooves 90*a*, 90*b* illustrated in FIG. 8. Furthermore, an outer side surface 130*b* of the side plate 130 is brought into contact with the guide projection 94 illustrated in FIG. 8.

The Side Plate 134

As illustrated in FIG. 14B, a projecting portion 134*a* is formed at a distal end portion of the side plate 134. The projecting portion 134*a* projects toward the side plate 130 and extends in the container circumferential direction. This projecting portion 134*a* is inserted into the guide groove 92 illustrated in FIG. 8.

With this structure, the opening/closing member 78 having been mounted to the lid portion 68 is moved in the container circumferential direction relative to the lid portion 68 along the outer circumferential surface 72*a* of the second cylindrical portion 72.

The Curved Plate 120

As illustrated in FIG. 14B, the protrusion 140 and a through hole 142 are formed in an inner circumferential surface 120*a* of the curved plate 120. The protrusion 140 is engaged with the recess 98*a* of the limiting portion 98 formed in the second cylindrical portion 72 (see FIG. 8). The through hole 142 penetrates through the curved plate 120. Furthermore, a rib 144 and a projecting portion 146 are formed in the curved plate 120. The plate-shaped rib 144 projects from the inner circumferential surface 120*a*. The projecting portion 146 projects from the inner circumferential surface 120*a* and has the suppressing plate 150 that suppresses a movement of the toner as the powder.

Figure 14A:
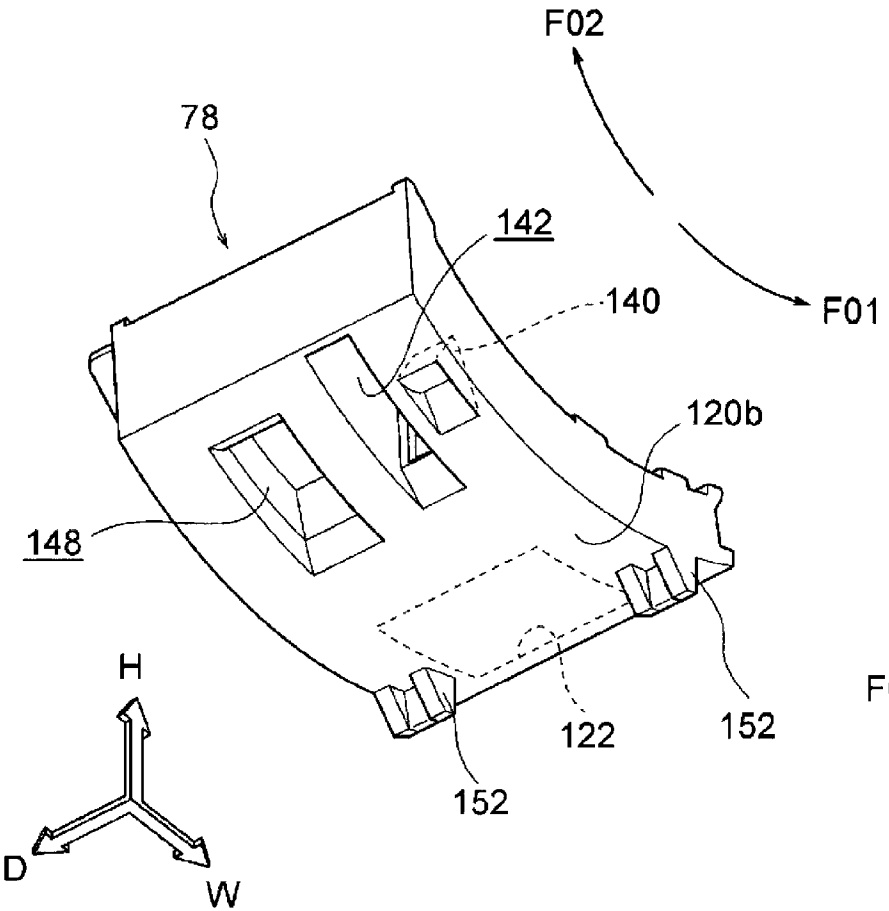

Furthermore, as illustrated in FIG. 14A, a pair of regulating projections 152 is formed on an outer circumferential surface 120*b* of the curved plate 120 so as to project from the outer circumferential surface 120*b*. Each of the regulating projections 152 is an example of an engagement portion.

Furthermore, a portion of the inner circumferential surface 120*a* of the curved plate 120 facing the opening 72*c* of the lid portion 68 in the state in which the opening/closing member 78 (see FIG. 8) is disposed at the closed position is defined as a facing portion 122. Thus, as illustrated in FIG. 14B, the projecting portion 146, the rib 144, the through hole 142, and the protrusion 140 are disposed on the other side relative to the facing portion 122 in the container circumferential direction.

The projecting portion 146, the rib 144, the through hole 142, and the protrusion 140 are arranged in this order from the rear part to the front part in the apparatus depth direction. In other words, the distance from the container portion 62 (see FIG. 12) increases in order from the projecting portion 146, the rib 144, the through hole 142, to the protrusion 140. That is, the projecting portion 146 is closest to the container portion 62 out of the projecting portion 146, the rib 144, the through hole 142, and the protrusion 140.

The protrusion 140 is disposed at a front part of the inner circumferential surface 120*a* of the curved plate 120 in the apparatus depth direction. As indicated by the two-dot chain line illustrated in FIG. 21, when the opening/closing member 78 is disposed at the closed position, the protrusion 140 is engaged with the recess 98*a* of the limiting portion 98. Such engagement between the protrusion 140 and the recess 98*a* of the limiting portion 98 limits the movement of the opening/closing member 78 relative to the lid portion 68 to the other side in the container circumferential direction. In other words, the engagement between the protrusion 140 and the recess 98*a* of the limiting portion 98 limits a movement of the lid portion 68 relative to the opening/closing member 78 to the one side in the container circumferential direction. In yet other words, the engagement between the protrusion 140 and the recess 98*a* of the limiting portion 98 limits the movements of the opening/closing member 78 and the lid portion 68 relative to each other in the container circumferential direction.

As illustrated in FIG. 14B, the through hole 142 has a rectangular shape extending in the container circumferential direction when seen from the outside in the container radial direction.

Figure 20:
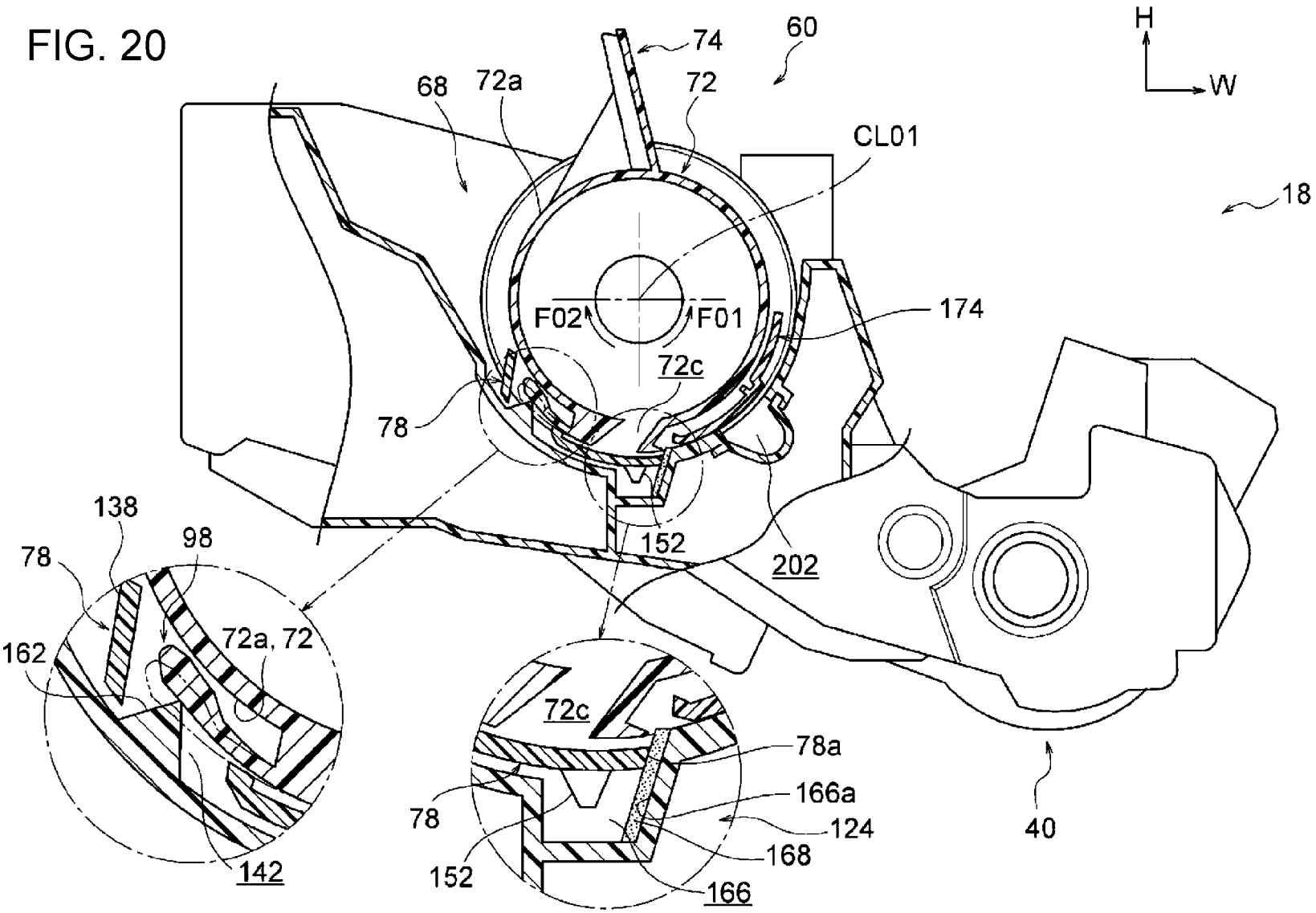
FIG. 20 is a sectional view illustrating the state in which the container is disposed at the temporarily placed position in the container mounting structure according to the exemplary embodiment of the present disclosure.

With this structure, as indicated by a two-dot chain line and a solid line illustrated in FIG. 20, from the outside of the opening/closing member 78, the limiting portion 98 is pushed up toward the outer circumferential surface 72*a* of the second cylindrical portion 72 through the through hole 142. This causes the limiting portion 98 to be elastically deformed. As a result, as indicated by the solid line illustrated in FIG. 21, the engagement between the protrusion 140 and the recess 98*a* of the limiting portion 98 is released.

Furthermore, as illustrated in FIG. 14B, the rib 144 projects from an edge portion of the through hole 142 near the projecting portion 146. The rib 144 has a plate shape with a plate surface thereof facing the apparatus depth direction. The rib 144 is an example of a suppressing wall.

As illustrated in FIG. 14B, the projecting portion 146 is disposed on the opposite side to the through hole 142 with the rib 144 interposed therebetween in the apparatus depth direction. The projecting portion 146 has a rectangular shape extending in the container circumferential direction when seen from the inside in the container radial direction.

Furthermore, as illustrated in FIG. 14A, a recess 148 is formed in a portion of the outer circumferential surface 120*b* of the curved plate 120 corresponding to the projecting portion 146. That is, the projecting portion 146 has a box shape that is open toward the outside in the container radial direction.

As illustrated in FIG. 14B, a portion of the projecting portion 146 on the one side in the container circumferential direction is formed by the suppressing plate 150 having a plate surface that faces in the container circumferential direction. This suppressing plate 150 is disposed, in the container circumferential direction, on the one side relative to (closer to the facing portion 122 than) the through hole 142.

Figure 19:
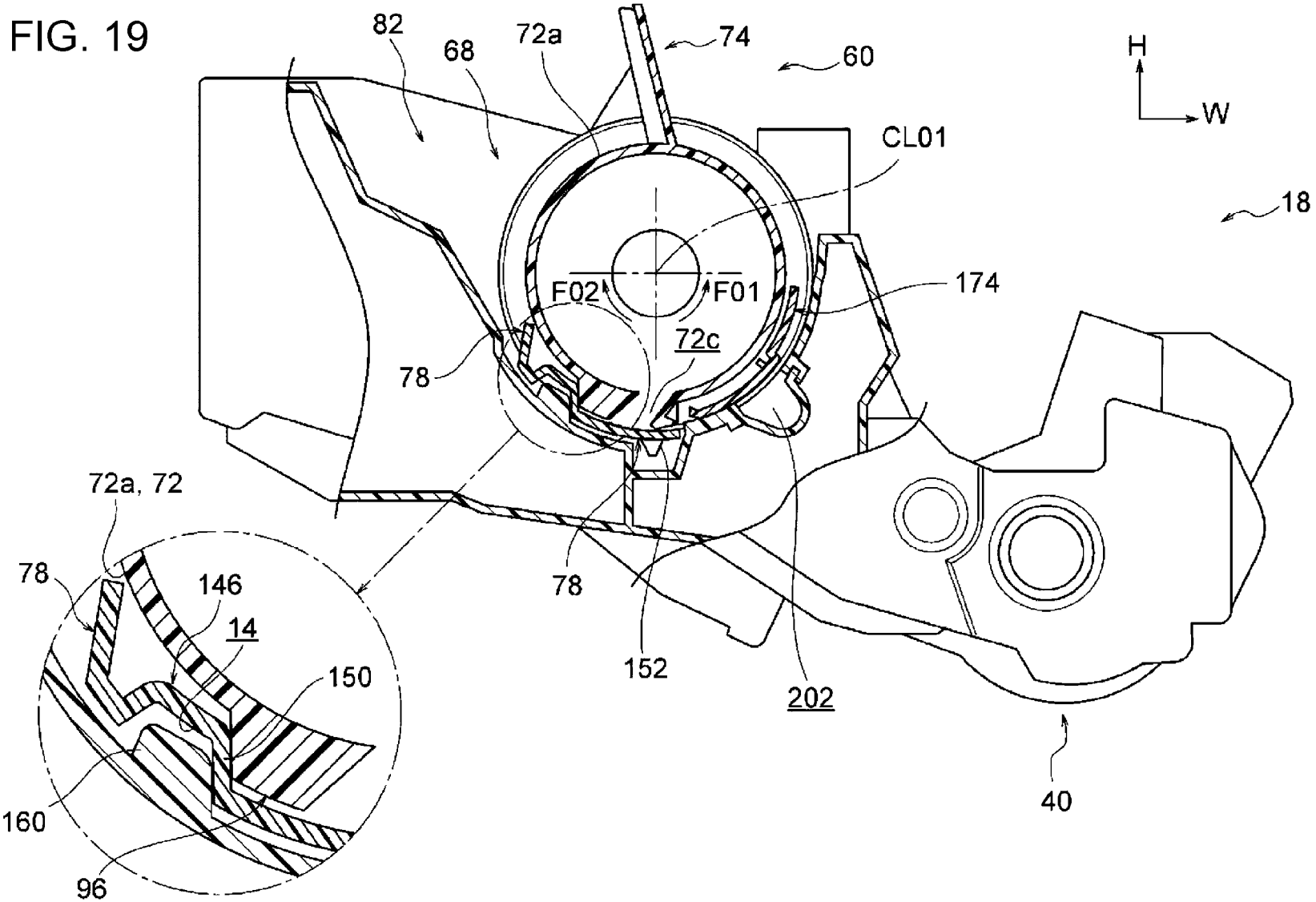
FIG. 19 is a sectional view illustrating the state in which the container is disposed at the temporarily placed position in the container mounting structure according to the exemplary embodiment of the present disclosure.

With this structure, when the opening/closing member 78 is disposed at the closed position, the suppressing plate 150 is in contact with the regulating projections 96 formed on the lid portion 68 in the container circumferential direction as illustrated in FIG. 19. Such contact between the suppressing plate 150 and the regulating projections 96 in the container circumferential direction regulates the movement of the opening/closing member 78 relative to the lid portion 68 to the one side in the container circumferential direction. In other words, the contact between the suppressing plate 150 and the regulating projections 96 in the container circumferential direction regulates the movement of the lid portion 68 relative to the opening/closing member 78 to the other side in the container circumferential direction. In yet other words, the contact between the suppressing plate 150 and the regulating projections 96 in the container circumferential direction regulates the movements of the opening/closing member 78 and the lid portion 68 relative to each other in the container circumferential direction.

Furthermore, two regulating projections 152 are provided and, as illustrated in FIG. 14A, project in the container radial direction from an end portion of the outer circumferential surface 120*b* of the curved plate 120 on the one side in the container circumferential direction. In other words, the distances between the central line CL01 and distal ends of the regulating projections 152 are larger than the distance between the central line CL01 and the outer circumferential surface 120*b*.

Specifically, in the state in which the container 60 is removed from the container mounting portion 82, the regulating projections 152 project in the opposite direction to the direction in which the gripping portion 74 projects. Furthermore, in the state in which the container 60 is disposed at the temporarily placed position, as illustrated in FIG. 19, the regulating projections 152 project downward (in the direction in which the container 60 is moved) when seen in the apparatus depth direction.

As illustrated in FIG. 14A, two regulating projections 152 are respectively disposed on the one side and the other side relative to the facing portion 122 in the apparatus depth direction.

Others

As illustrated in FIG. 8, the distal end portion 76 of the lid portion 68 is, as described above, open at the front in the apparatus depth direction. A transmitting portion 88 is disposed in the distal end portion 76. The transmitting portion 88 transmits to the container portion 62 of the container 60 a rotating force for rotating the container portion 62 in the container circumferential direction. A sealing member (not illustrated) is provided in the lid portion 68 so as to suppress leakage of the toner to the outside through a gap between the transmitting portion 88 and the distal end portion 76.

With this structure, when the rotating force is transmitted to the container portion 62 through the transmitting portion 88, the container portion 62 is rotated in the container circumferential direction without rotating the lid portion 68.

The Container Mounting Portion 82

Figure 7:
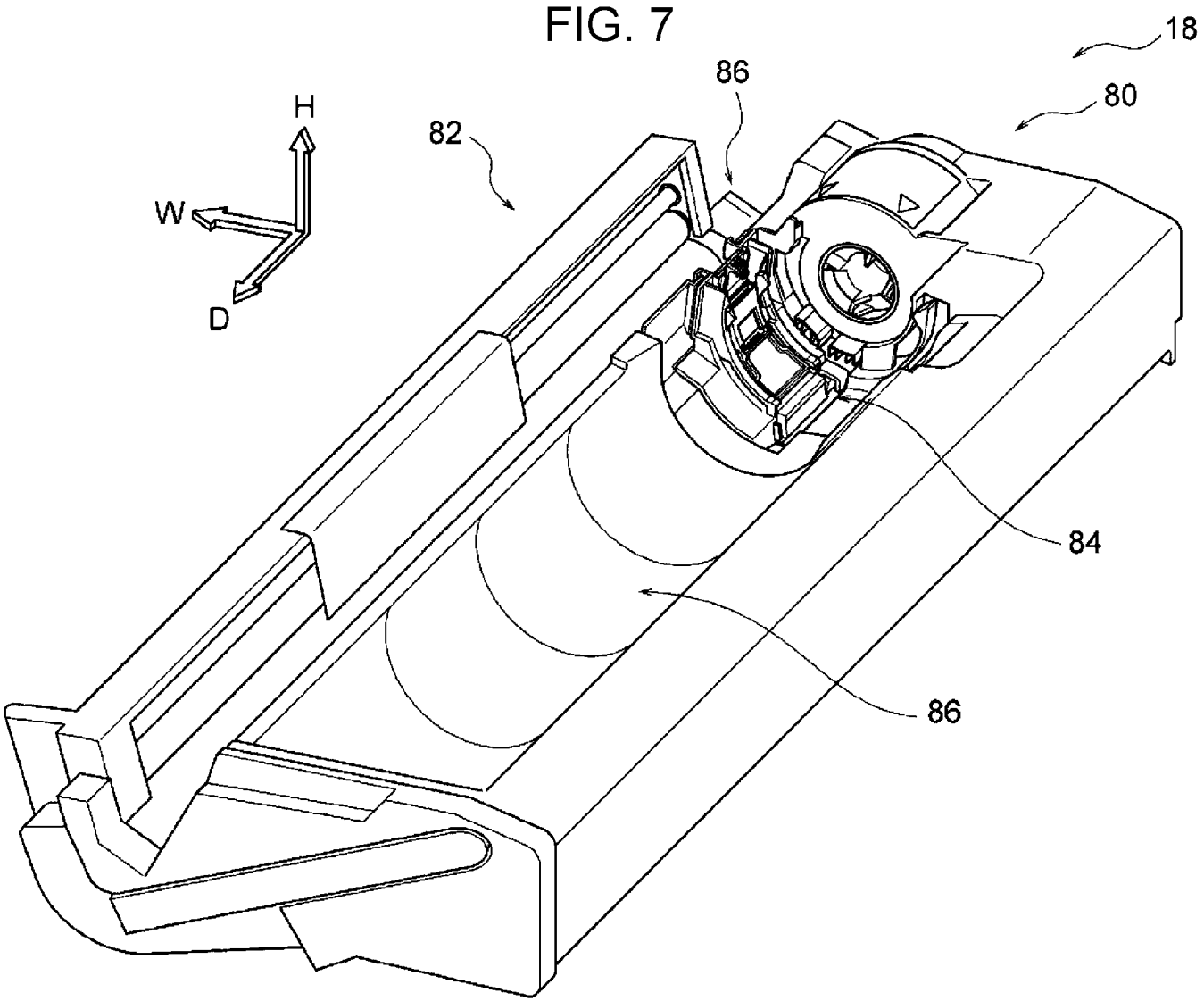
FIG. 7 is a perspective view of the container mounting portion of the container mounting structure according to the exemplary embodiment of the present disclosure.

As illustrated in FIG. 7, the container mounting portion 82 is formed in the unit body 80 of the image forming unit 18. The container mounting portion 82 extends in the apparatus depth direction and has a U shape that is open at the top. A first support portion 84 and a second support portion 86 are formed in the container mounting portion 82. The first support portion 84 supports the lid portion 68 of the container 60 (see FIG. 6) from below. The second support portion 86 has an arcuate shape in the section perpendicular to the longitudinal direction and supports the container portion 62 of the container 60 from below. The first support portion 84 and the second support portion 86 are arranged in this order from the front part to the rear part in the apparatus depth direction.

Figure 15:
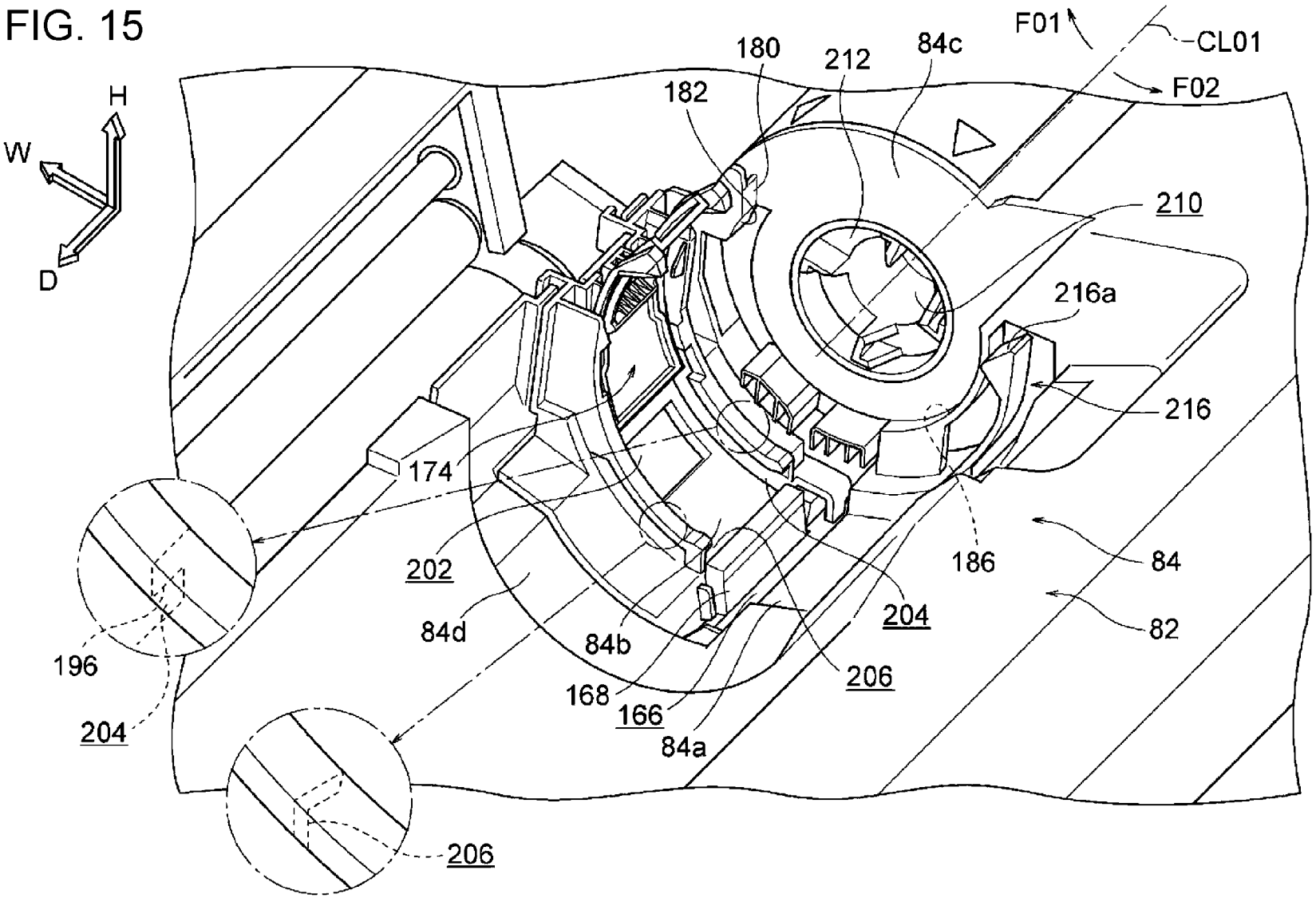
FIG. 15 is an enlarged perspective view of a container mounting portion used for the container mounting structure according to the exemplary embodiment of the present disclosure.

As illustrated in FIG. 15, the first support portion 84 has arcuate surfaces 84*b*, 84*d* having respective arcuate shapes and a rear surface 84*c* that is, in the apparatus depth direction, disposed in front of the arcuate surfaces 84*a*, 84*b*, 84*d* and faces rearward.

The arcuate surface 84*a* and the arcuate surface 84*b* are arranged in this order from the other side to the one side in the container circumferential direction. The arcuate surface 84*d* is disposed on the opposite side to the rear surface 84*c* with the arcuate surfaces 84*a*, 84*b* interposed therebetween in the apparatus depth direction and brought into contact with an outer circumferential surface 70*b* of the first cylindrical portion 70 of the lid portion 68 (see FIG. 8) so as to support the lid portion 68 from below.

Furthermore, the arcuate surface 84*b* has an opening 202 through which the toner is received from the container 60. The opening 202 has a rectangular shape extending in the apparatus depth direction when seen from the inside in the container radial direction.

Figure 17:
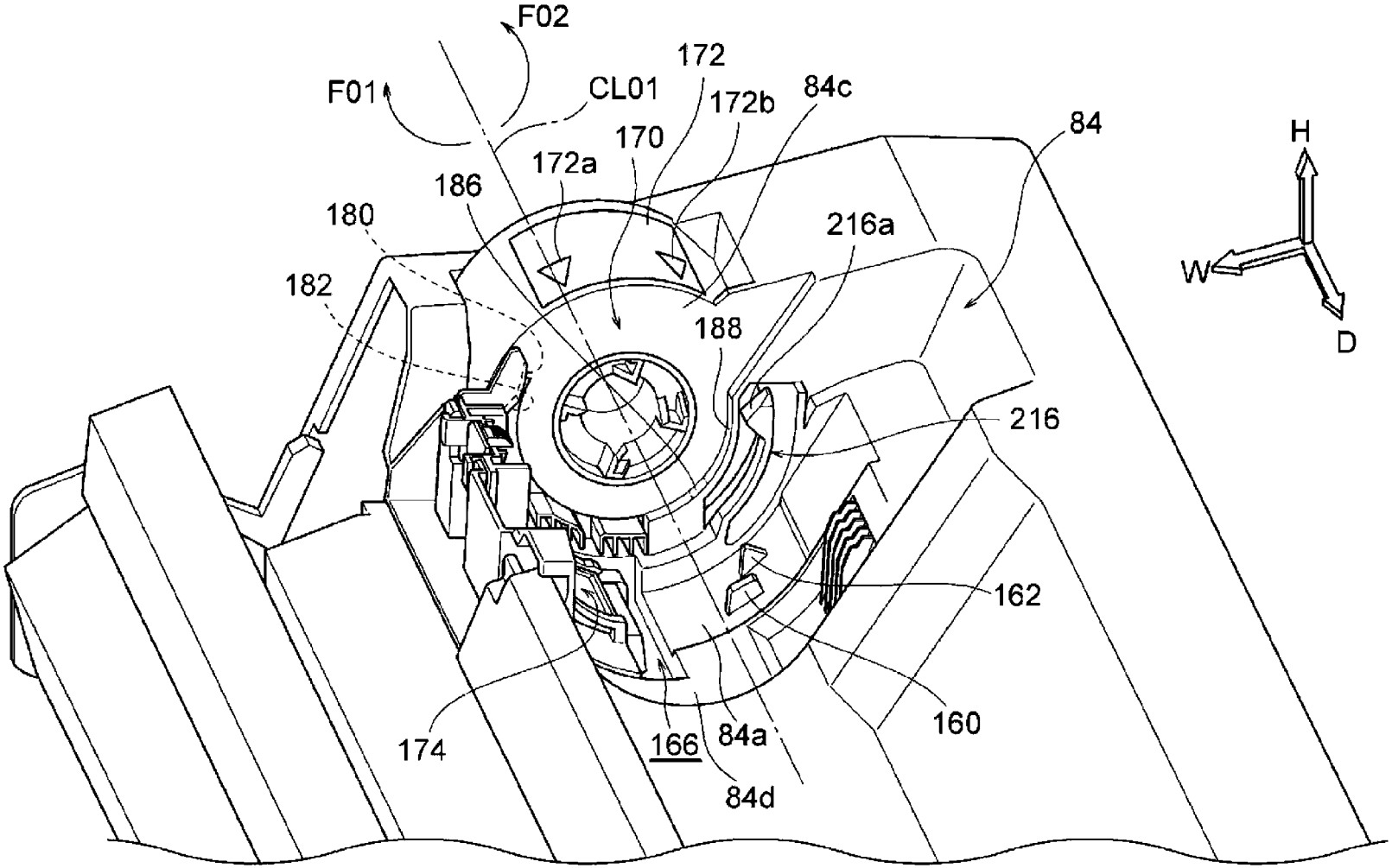
FIG. 17 is an enlarged perspective view of the container mounting portion used for the container mounting structure according to the exemplary embodiment of the present disclosure.

Furthermore, as illustrated in FIG. 17, the first support portion 84 has an inhibiting portion 160. In the state in which the container 60 is disposed at the temporarily placed position, the inhibiting portion 160 enters the recess 148 formed in the opening/closing member 78 of the container 60 (see FIG. 14A) so as to inhibit the movement of the opening/closing member 78. Furthermore, the first support portion 84 has a releasing projection 162. In the state in which the container 60 is disposed at the temporarily placed position, the releasing projection 162 releases the engagement between the protrusion 140 and the limiting portion 98 (see FIG. 21). The releasing projection 162 is an example of a releasing portion.

Furthermore, the first support portion 84 has a recess 166. In the state in which the container 60 is disposed at the temporarily placed position, the regulating projections 152 formed in the opening/closing member 78 (see FIG. 14A) enter the recess 166. Furthermore, the first support portion 84 includes a positioning mechanism 170 and an opening/closing member 174 (see FIGS. 15 and 16). The positioning mechanism 170 positions the container 60 mounted to the container mounting portion 82 relative to the container mounting portion 82. The opening/closing member 174 allows the opening 202 to be exposed and closes the opening 202 through which the toner is received from the container 60.

The Inhibiting Portion 160

As illustrated in FIG. 17, the inhibiting portion 160 projects upward from the arcuate surface 84*a* and has a trapezoidal shape when seen in the apparatus depth direction.

With this structure, as illustrated in FIG. 19, in the state in which the container 60 is disposed at the temporarily placed position, the inhibiting portion 160 enters the recess 148 formed in the opening/closing member 78. Thus, the inhibiting portion 160 is brought into contact with the suppressing plate 150 defining the recess 148 in the container circumferential direction, thereby inhibiting the movement of the opening/closing member 78 and the lid portion 68 to the other side in the container circumferential direction.

The Releasing Projection 162

As illustrated in FIG. 17, the releasing projection 162 projects upward from the arcuate surface 84*a* and is disposed in front of the inhibiting portion 160 in the apparatus depth direction. The releasing projection 162 has a triangular shape when seen in the apparatus depth direction.

With this structure, as illustrated in FIG. 20, in the state in which the container 60 is disposed at the temporarily placed position, the releasing projection 162 enters the through hole 142 formed in the opening/closing member 78. The releasing projection 162 pushes upward the limiting portion 98 of the lid portion 68. As a result, as indicated by the solid line illustrated in FIG. 21, the engagement between the protrusion 140 formed in the opening/closing member 78 and the recess 98*a* of the limiting portion 98 is released.

The Recess 166

As illustrated in FIG. 15, the recess 166 is formed between the arcuate surface 84*a* and the arcuate surface 84*b* in the container circumferential direction and extends in the apparatus depth direction. The recess 166 has a U shape in section that is open at the top. Furthermore, as illustrated in FIG. 20, a plate-shaped sponge material 168 is attached to a wall surface 166*a* that defines the recess 166 and faces the other side in the container circumferential direction. In the state in which the container 60 is disposed at the temporarily placed position, the sponge material 168 is separated from the regulating projections 152 formed in the opening/closing member 78 in the container circumferential direction. The sponge material 168 may be omitted from the drawings.

With this structure, in the state in which the container 60 is disposed at the temporarily placed position, the wall surface 166*a* defining the recess 166 faces, as illustrated in FIG. 20, an end surface 78*a* of the opening/closing member 78 on the one side in the container circumferential direction. The sponge material 168 is interposed between the wall surface 166*a* of the recess 166 and the end surface 78*a* of the opening/closing member 78. In other words, in the state in which the container 60 is disposed at the temporarily placed position, the rotation of the opening/closing member 78 to the one side in the container circumferential direction is blocked by the wall surface 166*a* and the sponge material 168.

As has been described, the wall surface 166*a* and the sponge material 168 form a blocking section 124 that blocks the rotation of the opening/closing member 78 to the one side in the container circumferential direction in the state in which the container 60 is disposed at the temporarily placed position.

Figure 28:
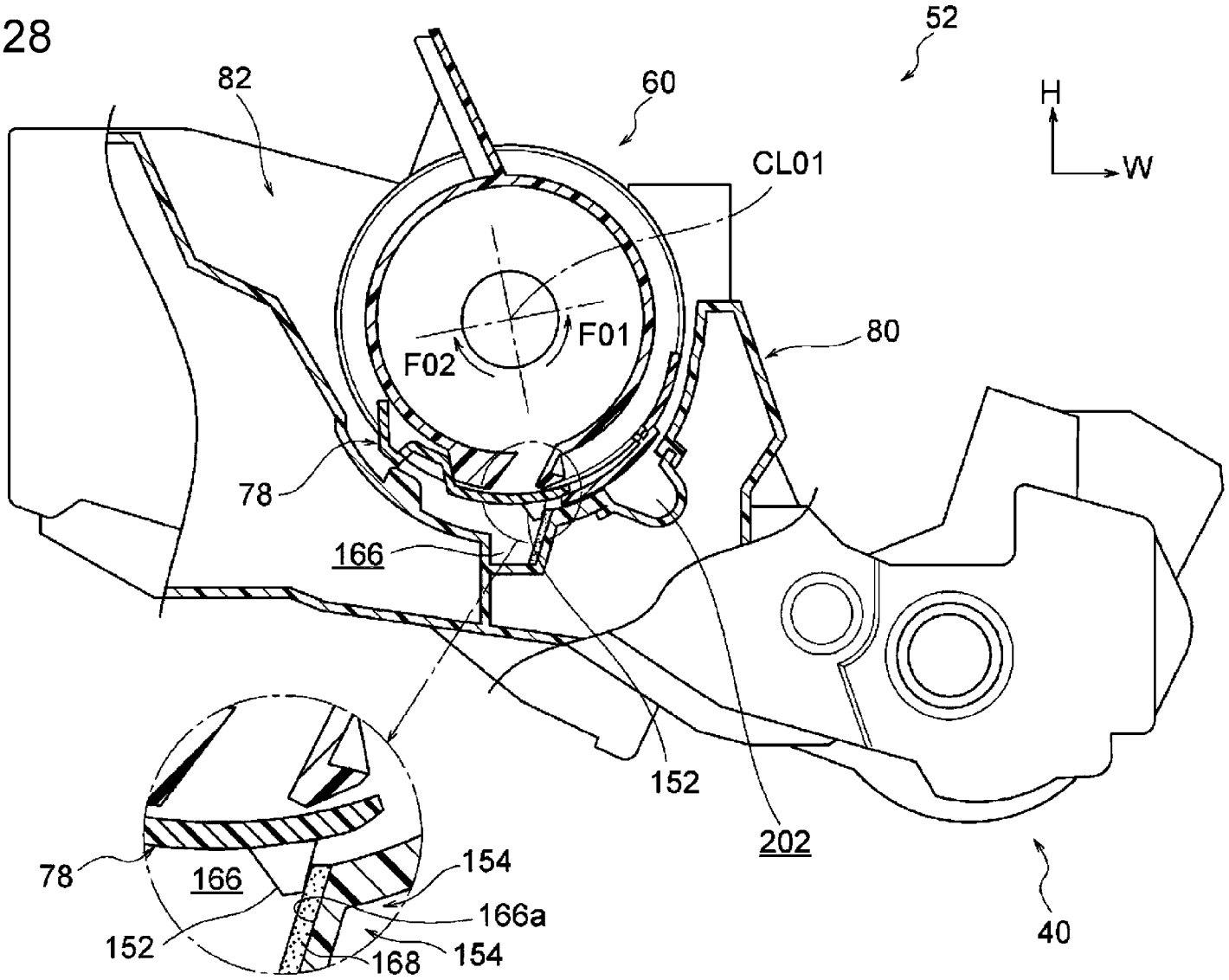
FIG. 28 is a sectional view illustrating the state in which the container is disposed at a position deviated from the temporarily placed position in the container mounting structure according to the exemplary embodiment of the present disclosure.

Furthermore, although the details will be described later, when the container 60 disposed at a position deviated from the temporarily placed position is rotated to the one side in the container circumferential direction, as illustrated in FIG. 28, the regulating projections 152 of the opening/closing member 78 push the sponge material 168 attached to the wall surface 166*a*. The wall surface 166*a* of the recess 166 and the sponge material 168 regulate the movement of the opening/closing member 78 to the one side in the container circumferential direction.

As has been described, the wall surface 166*a* and the sponge material 168 form an engagement section 154 that is brought into engagement with the regulating projections 152 when the container 60 is rotated to the one side in the container circumferential direction in the state in which the container 60 is disposed at a position deviated from the temporarily placed position. In this way, the regulating projections 152 function as rotation regulating members that regulate the rotation to the one side in the container circumferential direction.

Furthermore, as has been described, the regulating projections 152 are respectively disposed on the one side and the other side relative to the facing portion 122 in the apparatus depth direction. This suppresses inclination of the opening/closing member 78 relative to the container circumferential direction when the regulating projections 152 push the sponge material 168 attached to the wall surface 166*a* compared to the case where a single regulating projection is formed. From the viewpoint of suppressing the inclination of the opening/closing member 78 relative to the container circumferential direction, the pitch of two regulating projections 152 may be increased. That is, the regulating projections 152 may be formed at respective end portions of the opening/closing member 78 in the apparatus depth direction.

The Positioning Mechanism 170

Figure 16:
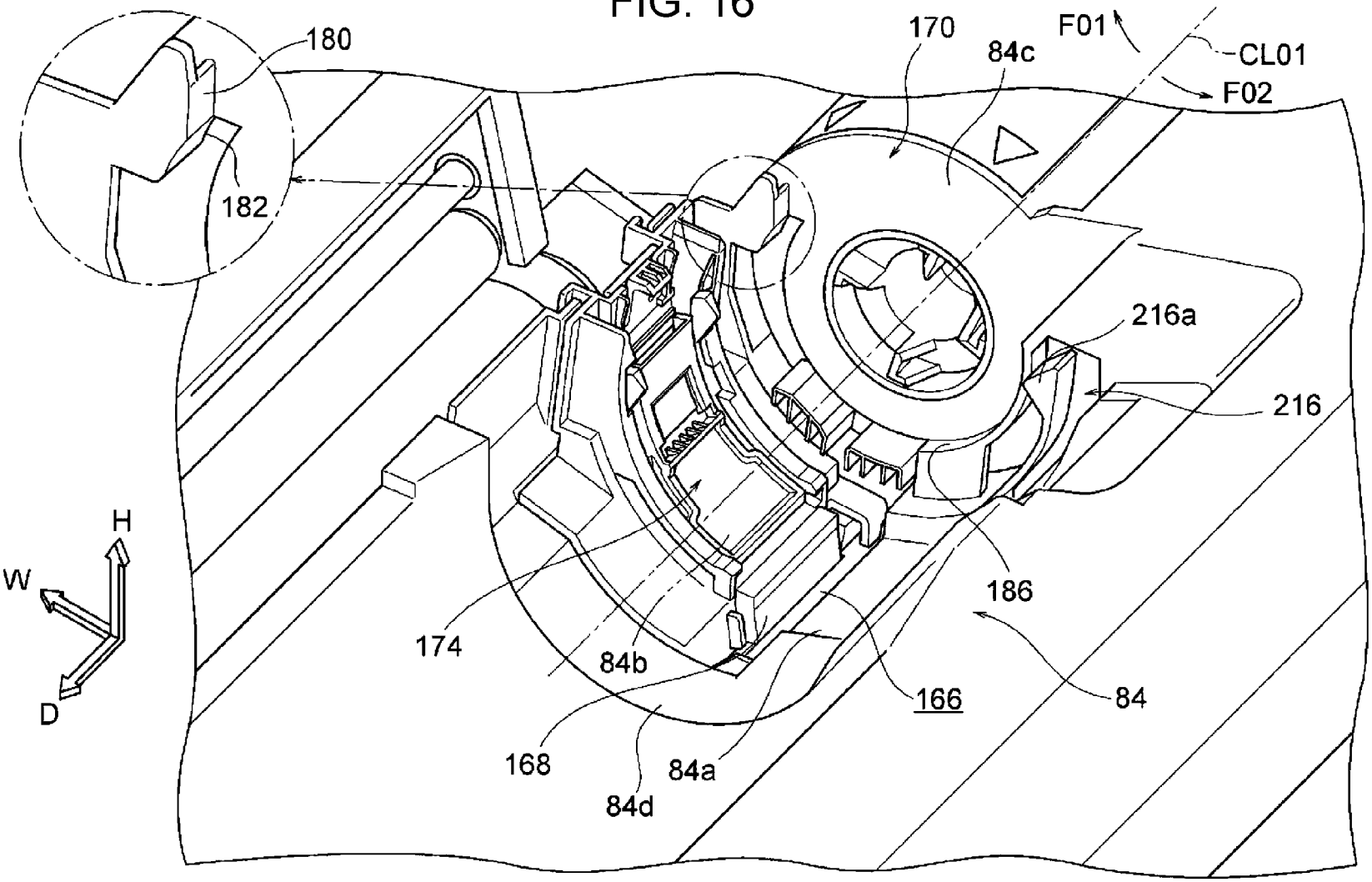
FIG. 16 is an enlarged perspective view of the container mounting portion used for the container mounting structure according to the exemplary embodiment of the present disclosure.

As illustrated in FIG. 16, the positioning mechanism 170 has an intersecting surface 180 that is disposed between the arcuate surface 84*a* and the rear surface 84*c* in the apparatus depth direction and extends in a direction intersecting the apparatus depth direction (apparatus up-down direction). The container 60 is disposed at the temporarily placed position by bringing the guide surface 108 of the lid portion 68 (see FIG. 11) into contact with this intersecting surface 180. The positioning mechanism 170 further has a contact surface 182. The contact surface 182 is disposed between the arcuate surface 84*a* and the rear surface 84*c* in the apparatus depth direction and is, in the state in which the container 60 is disposed at the mounted position, in contact with the contact surface 104 of the lid portion 68 (see FIG. 9).

The positioning mechanism 170 further has a contact surface 186 as illustrated in FIG. 17. The contact surface 186 is disposed between the arcuate surface 84*a* and the rear surface 84*c* in the apparatus depth direction and is, in the state in which the container 60 is disposed at the mounted position, in contact with the contact surface 102 of the lid portion 68 (see FIG. 10).

The positioning mechanism 170 further has a contact surface 196 as illustrated in FIG. 15. The contact surface 196 is disposed in a portion behind the arcuate surface 84*b* in the apparatus depth direction and is, in the state in which the container 60 is disposed at the mounted position, in contact with the contact surface 106 of the lid portion 68 (see FIG. 8).

The Intersecting Surface 180 and the Contact Surface 182

As illustrated in FIG. 16, the intersecting surface 180 and the contact surface 182 are disposed on the other side relative to the central line CL01 in the apparatus width direction and are adjacent to each other from the upper side to lower side in this order.

The intersecting surface 180 has a flat shape and extends in the apparatus up-down direction that is a direction intersecting the apparatus depth direction. The intersecting surface 180 faces the one side in the apparatus width direction. Furthermore, when seen in the direction in which the intersecting surface 180 faces, the intersecting surface 180 has a rectangular shape extending in the apparatus up-down direction. This contact surface 182 has an arcuate shape centered at the central line CL01 when seen in the apparatus depth direction and faces inward in the container radial direction.

As illustrated in FIG. 18, with this structure, when the container 60 is moved with the guide surface 108 and the intersecting surface 180 in contact with each other, the container 60 is moved in the apparatus up-down direction. Then, the container 60 is moved downward in the apparatus up-down direction so as to be disposed at the temporarily placed position.

Figure 23:
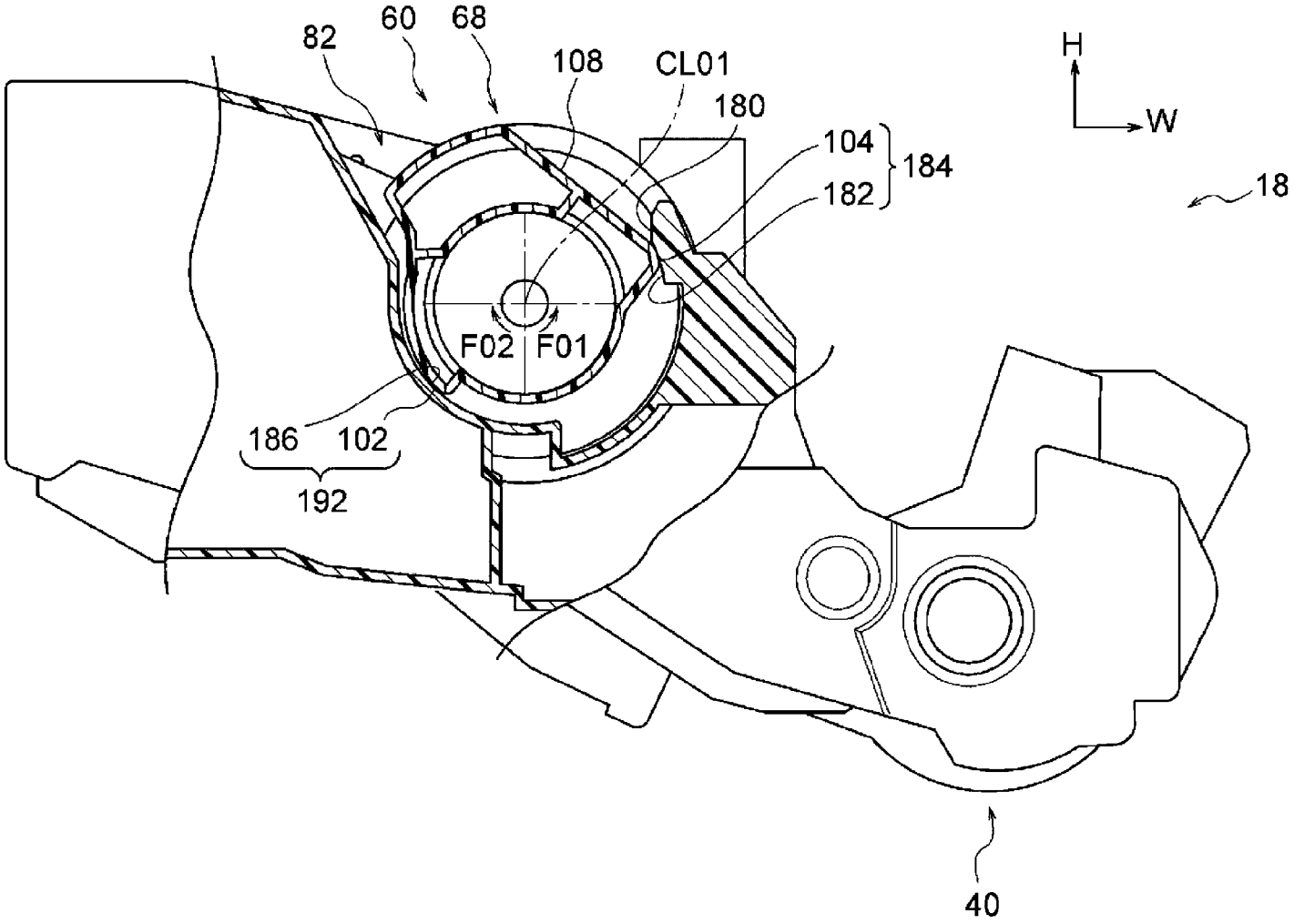
FIG. 23 is a sectional view illustrating the state in which the container is disposed at the mounted position in the container mounting structure according to the exemplary embodiment of the present disclosure.

Furthermore, when the container 60 disposed at the temporarily placed position is rotated to the one side in the container circumferential direction so as to be disposed at the mounted position, the contact surface 104 of the lid portion 68 is brought into contact with the contact surface 182 of the container mounting portion 82 as illustrated in FIG. 23. Specifically, the contact surface 104 of the lid portion 68 is brought into surface contact with the contact surface 182 from the inside (a position near the central line CL01) relative to the contact surface 182 in the container radial direction.

Thus, the contact surface 104 and the contact surface 182 form a contact section 184 where the container 60 is in contact with the container mounting portion 82 from inside in the container radial direction.

The Contact Surface 186 and Others

As illustrated in FIG. 17, the contact surface 186 is disposed on the one side relative to the central line CL01 in the apparatus width direction. The contact surface 186 has an arcuate shape centered at the central line CL01 when seen in the apparatus depth direction and faces inward in the container radial direction.

Furthermore, an auxiliary surface 188 having a curved shape is formed on the other side relative to the contact surface 186 in the container circumferential direction. The auxiliary surface 188 is disposed at a region having a larger diameter than that of the contact surface 186.

With this structure, as illustrated in FIG. 18, in the state in which the container 60 is disposed at the temporarily placed position, the contact surface 102 of the lid portion 68 and the auxiliary surface 188 are kept separated from each other in the container radial direction. Furthermore, when the container 60 disposed at the temporarily placed position is rotated to the one side in the container circumferential direction so as to be disposed at the mounted position, the contact surface 102 of the lid portion 68 is brought into contact with the contact surface 186 of the container mounting portion 82 as illustrated in FIG. 23. Specifically, the contact surface 102 of the lid portion 68 is in surface contact with the contact surface 186 from the inside (a position near the central line CL01) relative to the contact surface 186 in the container radial direction.

Thus, the contact surface 102 and the contact surface 186 form a contact section 192 where the container 60 is in contact with the container mounting portion 82 from inside in the container radial direction.

The Contact Surface 196

The contact surface 196 is formed at a portion in front of the arcuate surface 84*b* in the apparatus depth direction. As illustrated in FIG. 15, the contact surface 196 is disposed, in the container circumferential direction, at a position on the one side relative to the contact surface 186 and on the other side relative to the contact surface 182. The contact surface 196 has an arcuate shape centered at the central line CL01 when seen in the apparatus depth direction and faces outward in the container radial direction.

Figure 22:
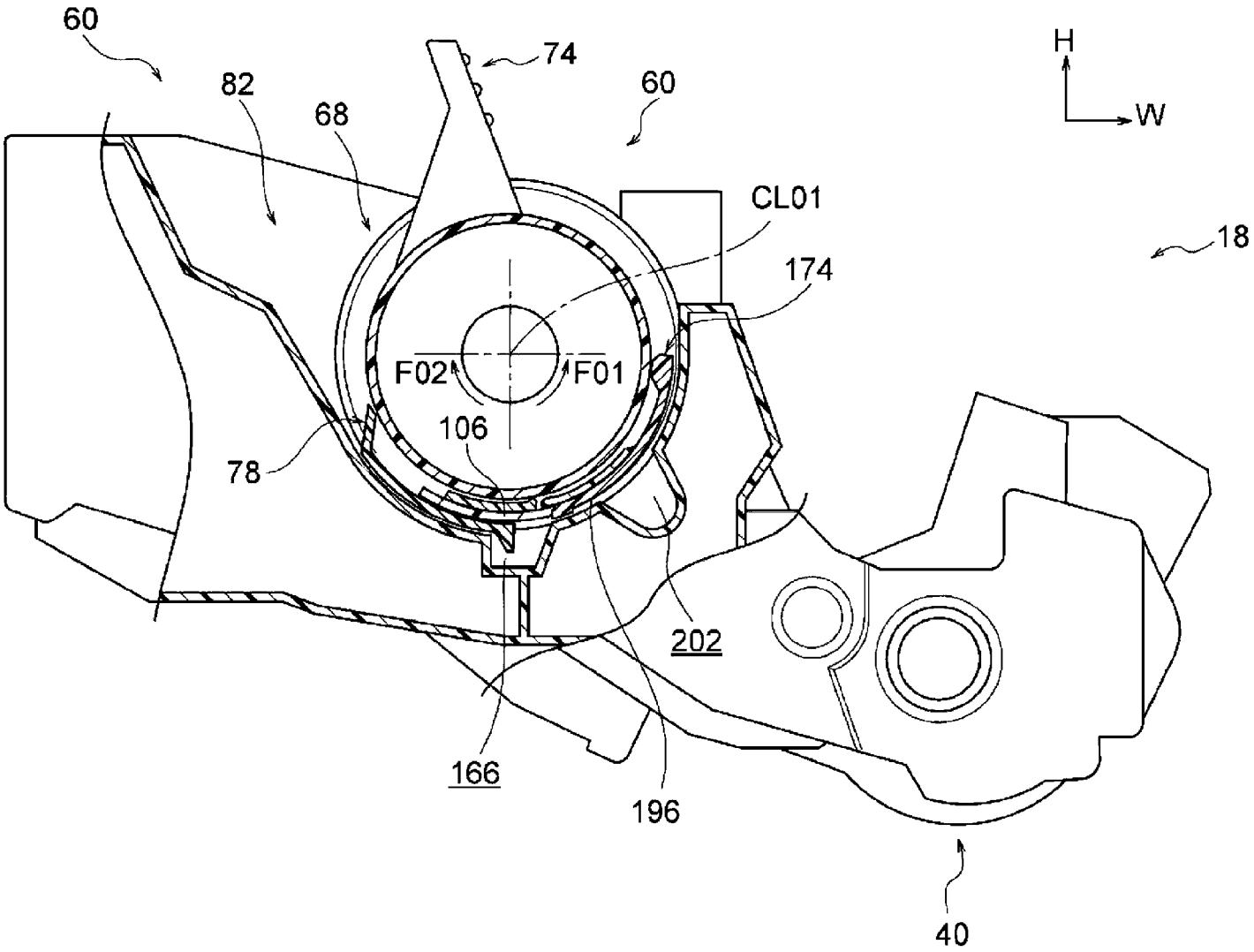
FIG. 22 is a sectional view illustrating the state in which the container is disposed at the temporarily placed position in the container mounting structure according to the exemplary embodiment of the present disclosure.
Figure 24:
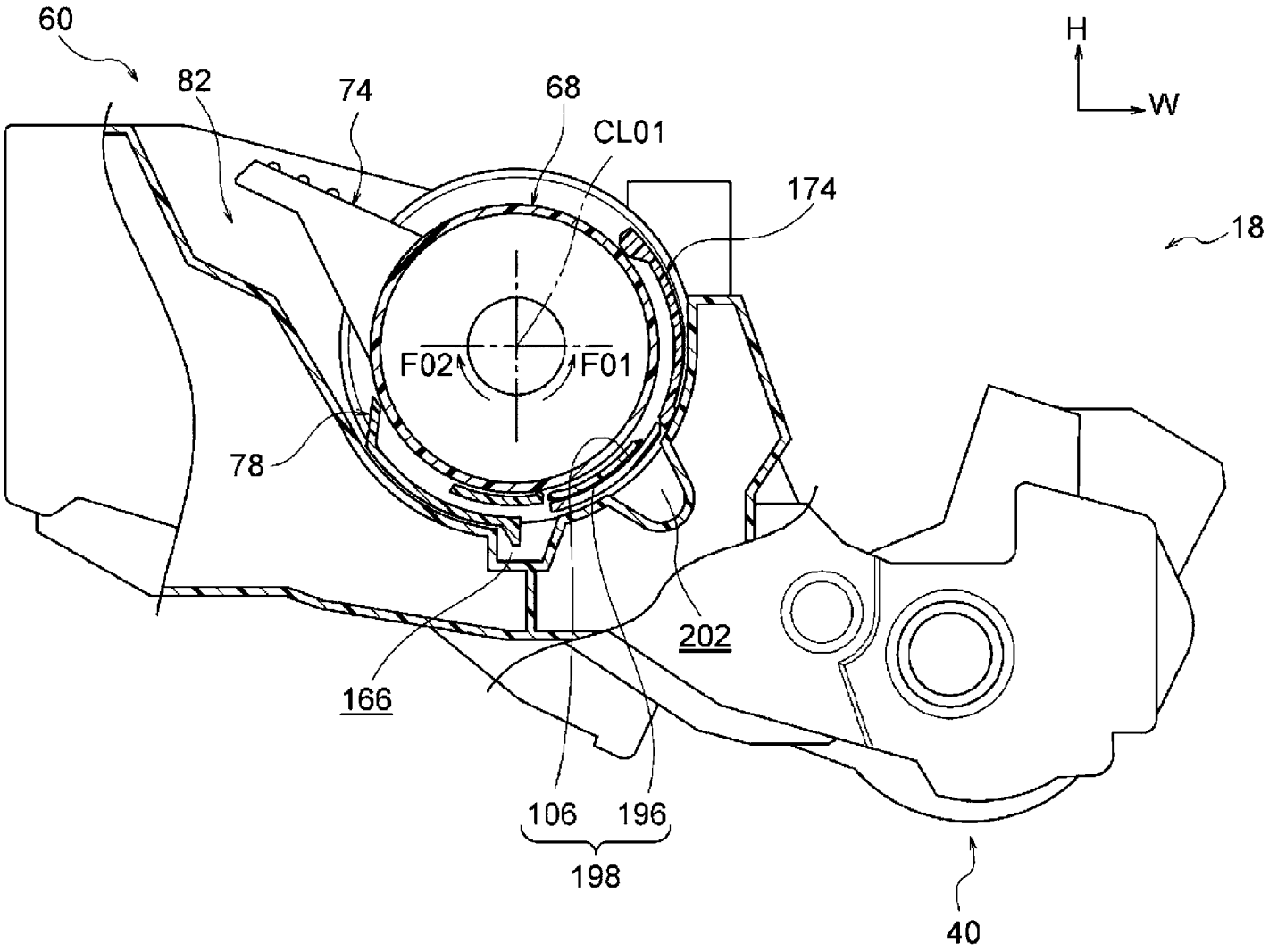
FIG. 24 is a sectional view illustrating the state in which the container is disposed at the mounted position in the container mounting structure according to the exemplary embodiment of the present disclosure.

With this structure, as illustrated in FIG. 22, in the state in which the container 60 is disposed at the temporarily placed position, the contact surface 106 of the lid portion 68 and the contact surface 196 of the container mounting portion 82 are kept separated from each other in the container circumferential direction. Furthermore, when the container 60 disposed at the temporarily placed position is rotated to the one side in the container circumferential direction so as to be disposed at the mounted position, as illustrated in FIG. 24, the contact surface 106 of the lid portion 68 is inserted into a guide groove 204 (see FIG. 15), which will be described later. Thus, the contact surface 106 of the lid portion 68 is brought into contact with the contact surface 196 of the container mounting portion 82. Specifically, the contact surface 106 of the lid portion 68 is brought into surface contact with the contact surface 196 from the outside relative to the contact surface 196 in the container radial direction.

Thus, the contact surface 106 and the contact surface 196 form a contact section 198 where the container 60 is in contact with the container mounting portion 82 from outside in the container radial direction.

As has been described, in the state in which the container 60 is disposed at the mounted position, the container 60 and the container mounting portion 82 are in contact with each other in the container radial direction at three contact sections 184, 192, 198 in the container circumferential direction. Thus, the container 60 is positioned relative to the container mounting portion 82 in the container radial direction.

Furthermore, the transmitting portion 88 is disposed at the front part of the container 60 in the apparatus depth direction as has been described (see FIG. 8). The transmitting portion 88 transmits to the container portion 62 of the container 60 a rotating force for rotating the container portion 62 in the container circumferential direction. All the contact sections 184, 192, 198 are formed in a front region in the apparatus depth direction of the container 60. In other words, all the contact sections 184, 192, 198 are formed in a region where the transmitting portion 88 is disposed in the container 60.

Here, the front region in the apparatus depth direction of the container 60 refers to a region within 20% from a front end portion of the container 60 in the apparatus depth direction when the length of the container 60 in the apparatus depth direction is 100%.

Others

As illustrated in FIG. 15, the rear surface 84*c* has a circular hole 210 centered at the central line CL01. The container mounting portion 82 includes a transmitting portion 212 that projects toward the container 60 disposed at the mounted position through the circular hole 210 so as to transmit the rotating force to the transmitting portion 88 (see FIG. 8) of the container 60.

With this structure, when the container 60 disposed at the temporarily placed position is rotated to the one side in the container circumferential direction so as to be disposed at the mounted position, a mechanical structure (not illustrated) is operated so as to cause the transmitting portion 212 to project through the circular hole 210. Thus, the transmitting portion 212 is brought into engagement with the transmitting portion 88 of the container 60. In this way, the transmitting portion 212 rotated by a motor (not illustrated) transmits the rotating force to the transmitting portion 88. In contrast, when the container 60 disposed at the mounted position is rotated to the other side in the container circumferential direction so as to be disposed at the temporarily placed position, the transmitting portion 212 does not project through the circular hole 210.

Furthermore, as illustrated in FIG. 17, the container mounting portion 82 includes a holding portion 216 that holds the container 60 disposed at the mounted position. The holding portion 216 is disposed in front of the arcuate surface 84*a* in the apparatus depth direction and on the one side relative to the central line CL01 in the apparatus width direction. The holding portion 216 extends in the up-down direction. The holding portion 216 has a cantilever shape in which an upper end is a free end. The holding portion 216 has a projection 216*a* projecting toward the central line CL01 at its upper end portion.

Figure 26B:
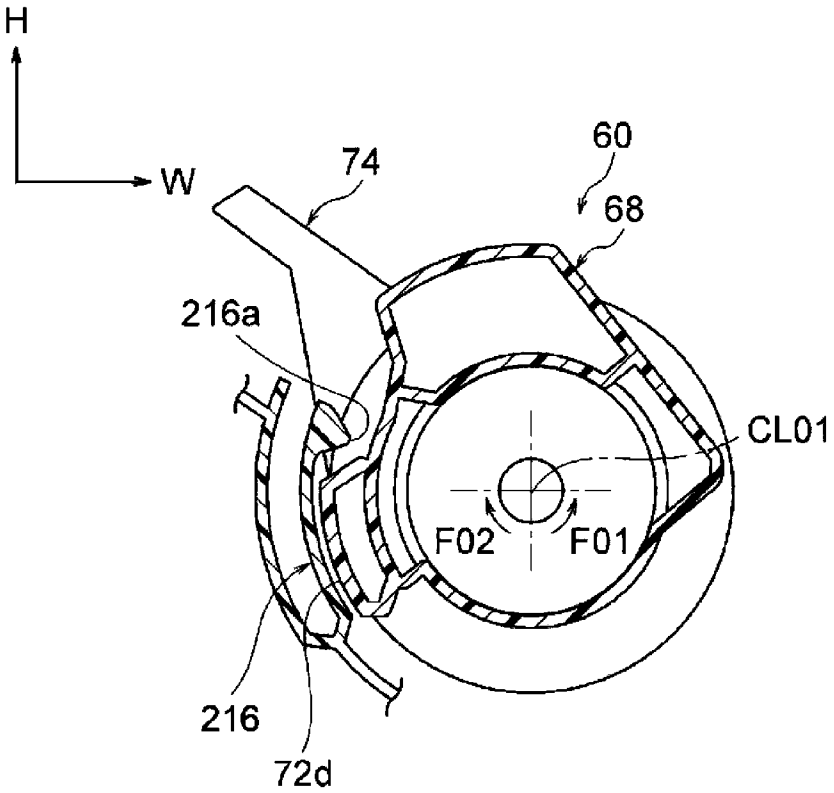
FIGS. 26A and 26B are sectional views respectively illustrating the state in which the container is disposed at the temporarily placed position and the state in which the container is disposed at the mounted position in the container mounting structure according to the exemplary embodiment of the present disclosure.
Figure 26A:
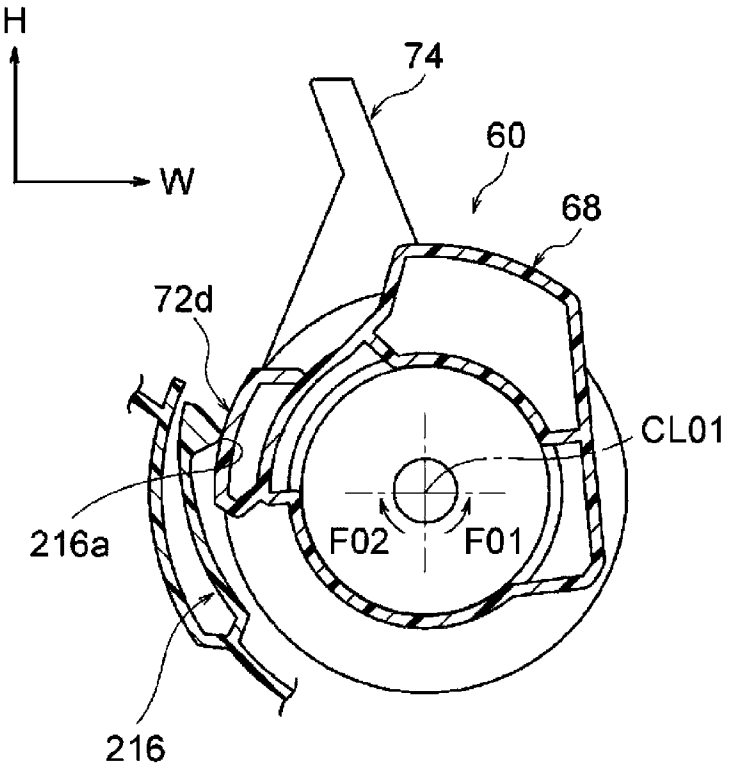

With this structure, when the container 60 is disposed at the temporarily placed position, as illustrated in FIG. 26A, the extended surface 72*d* of the lid portion 68 is brought into contact with the projection 216*a* of the holding portion 216. This causes the holding portion 216 to be bent and elastically deformed about a base end portion. Furthermore, when the container 60 disposed at the temporarily placed position is rotated to the one side in the container circumferential direction so as to be disposed at the mounted position, as illustrated in FIG. 26B, the projection 216*a* and the extended surface 72*d* are separated from each other in the container circumferential direction, thereby the holding portion 216 is elastically returned to its original shape. In this state, when the projection 216*a* of the holding portion 216 covers, from above, a portion of the lid portion 68 where the extended surface 72*d* is formed, the holding portion 216 holds the container 60 disposed at the mounted position.

Furthermore, as illustrated in FIG. 17, the container mounting portion 82 has a marked surface 172 extending from an upper edge portion of the rear surface 84*c* toward the front in the apparatus depth direction. The marked surface 172 is an arcuate surface facing outward in the container radial direction. The marked surface 172 has triangular marks 172*a* and 172*b* the vertices of which point toward the rear in the apparatus depth direction. The mark 172*a* and the mark 172*b* are kept separated from each other in the container circumferential direction and arranged in this order from the other side to the one side in the container circumferential direction.

With this structure, as illustrated in FIG. 5, in the state in which the container 60 is disposed at the temporarily placed position, the mark 112*a* of the container 60 and the mark 172*a* of the container mounting portion 82 face each other in the apparatus depth direction. In contrast, as illustrated in FIG. 4, in the state in which the container 60 is disposed at the mounted position, the mark 112*a* of the container 60 and the mark 172*b* of the container mounting portion 82 face each other in the apparatus depth direction.

The Opening/Closing Member 174 and Others

The opening/closing member 174 is mounted to the arcuate surface 84*b* and, as illustrated in FIG. 15, moved to an open position where the opening/closing member 174 allows the opening 202 formed in the arcuate surface 84*b* to be exposed and a closed position (see FIG. 16) where the opening/closing member 174 closes the opening 202. The opening/closing member 174 is a plate having an arcuate shape along the arcuate surface 84*b* and has a rectangular shape extending in the apparatus circumferential direction when seen from the inside in the container radial direction.

The arcuate surface 84*b* has a pair of guide grooves 204 and 206 kept separated from each other in the apparatus depth direction. The guide grooves 204 and 206 guide the opening/closing member 174 in the container circumferential direction.

The guide groove 204 extends in the container circumferential direction in a portion of the arcuate surface 84*b* near the rear surface 84*c* and has a U shape in section which is open at the rear in the apparatus depth direction (portion near the opening 202). The guide groove 204 is provided with the above-described contact surface 196 facing outward in the container radial direction.

The guide groove 206 extends in the container circumferential direction in a portion opposite to the guide groove 204 with the opening 202 interposed therebetween in the apparatus depth direction and has a U shape in section which is open at the front in the apparatus depth direction (a portion near the opening 202).

A front edge portion of the opening/closing member 174 in the apparatus depth direction is inserted into the guide groove 204, and a rear edge portion of the opening/closing member 174 in the apparatus depth direction is inserted into the guide groove 206.

Figure 25:
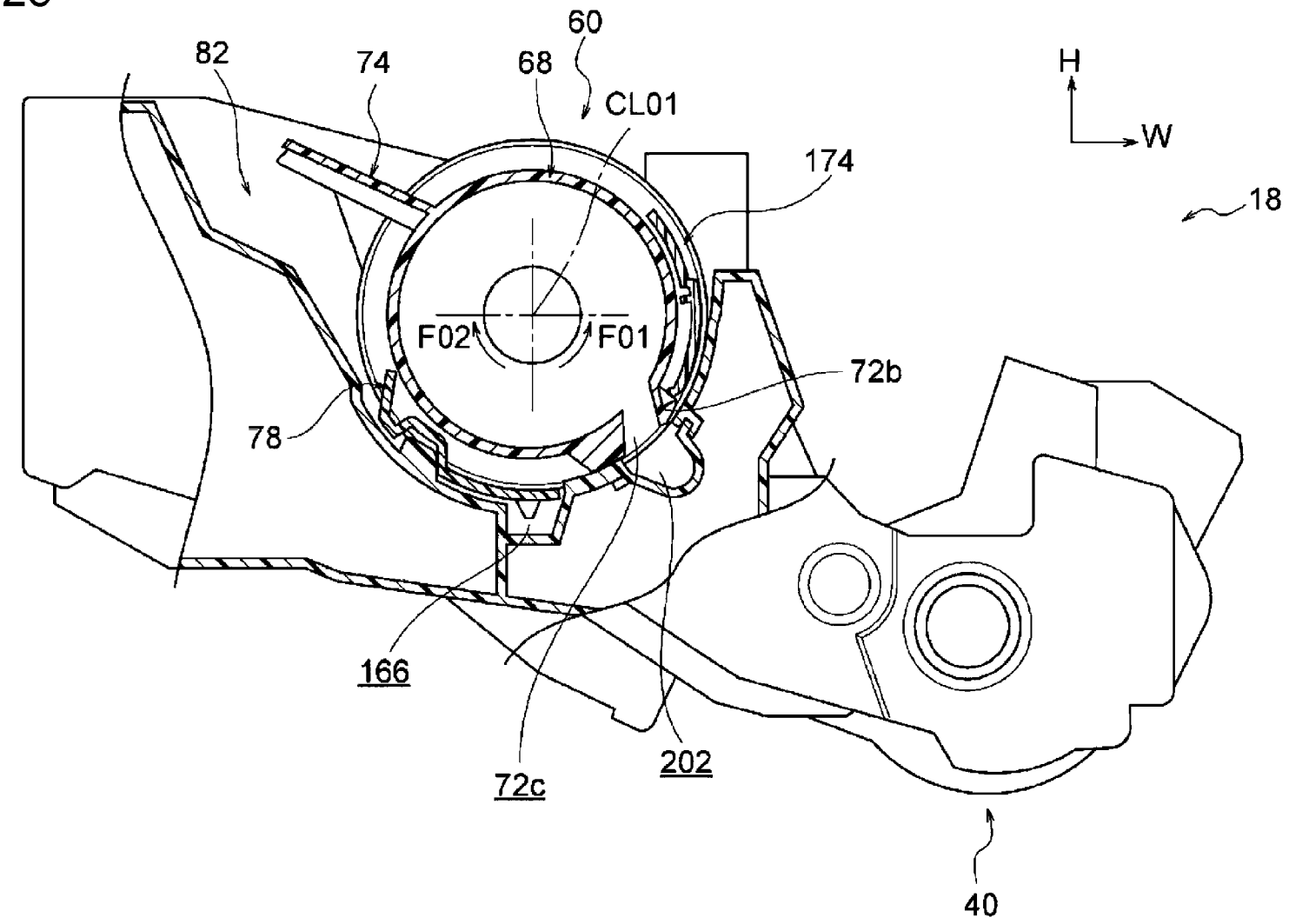
FIG. 25 is a sectional view illustrating the state in which the container is disposed at the mounted position in the container mounting structure according to the exemplary embodiment of the present disclosure.

With this structure, as illustrated in FIG. 19, in a state in which the opening/closing member 174 is disposed at the closed position and the container 60 is disposed at the temporarily placed position, the container 60 is rotated to the one side in the container circumferential direction so as to be moved to the mounted position. Consequently, as illustrated in FIG. 25, the opening/closing member 174 is pushed to the one side in the container circumferential direction by an end surface of the step portion 72*b* formed in the lid portion 68 so as to be moved from the closed position to the open position.

In contrast, when the container 60 disposed at the mounted position is rotated to the other side in the container circumferential direction so as to be moved to the temporarily placed position, the opening/closing member 174 is pushed to the other side in the container circumferential direction by a projection (not illustrated) formed in the lid portion 68 so as to be moved from the open position to the closed position.

Next, operations of the above-described structure are described. First, a container mounting structure 552 according to a comparative embodiment is described by focusing on the difference between the container mounting structure 552 according to the comparative embodiment and the container mounting structure 52 according to the present exemplary embodiment. Also, operations of the container mounting structure 552 are described by focusing on the difference between the operations of the container mounting structure 552 and operations of the container mounting structure 52 according to the present exemplary embodiment.

The Container Mounting Structure 552

Figure 31:
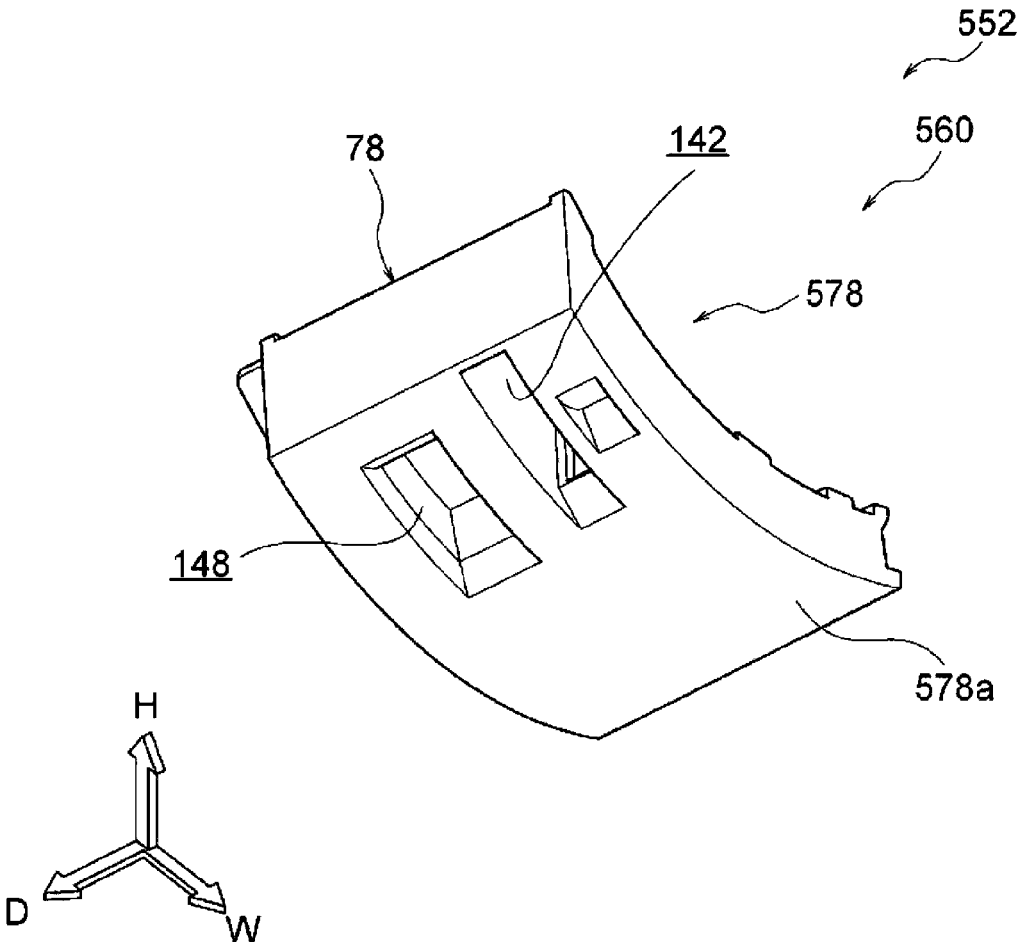
FIG. 31 is a perspective views of an opening/closing member mounted to the container used for the container mounting structure according to the comparative embodiment compared to the exemplary embodiment of the present disclosure.

As illustrated in FIG. 31, no regulating projection is formed in an outer circumferential surface 578*a* of an opening/closing member 578 provided in a container 560 of a container mounting structure 552.

Operations of the Container Mounting Structures 52, 552

In order to mount the container 60 to the container mounting portion 82 formed in the unit body 80, as illustrated in FIG. 6, the container 60 is oriented such that the distal end of the gripping portion 74 of the container 60 faces upward. In the state in which the container 60 is removed from the container mounting portion 82, the opening/closing members 78, 174 are disposed at the respective closed positions (see FIGS. 10 and 16). Furthermore, the protrusion 140 formed in the opening/closing member 78 and the recess 98*a* of the limiting portion 98 are engaged with each other (see the two-dot chain line in FIG. 21).

Then, as illustrated in FIGS. 5 and 6, with the above-described orientation maintained, the container 60 is moved from a position above the unit body 80 such that the container 60 approaches the container mounting portion 82.

Furthermore, as indicated by the two-dot chain line and the solid line illustrated in FIG. 18, the container 60 is moved downward while the guide surface 108 of the container 60 being in contact with the intersecting surface 180 of the container mounting portion 82. Then, when the outer circumferential surface 70*b* (see FIG. 12) of the first cylindrical portion 70 of the lid portion 68 is brought into contact with (placed on) the arcuate surface 84*d* (see FIG. 17) of the container mounting portion 82, the container 60 is disposed at the temporarily placed position.

As illustrated in FIG. 5, in the state in which the container 60 is disposed at the temporarily placed position, the mark 112*a* of the container 60 and the mark 172*a* of the container mounting portion 82 face each other in the apparatus depth direction. Furthermore, in this state, as illustrated in FIG. 26A, the extended surface 72*d* of the lid portion 68 is brought into contact with the projection 216*a* of the holding portion 216. This causes the holding portion 216 to be bent and elastically deformed about the base end portion.

Furthermore, as illustrated in FIG. 20, in the state in which the container 60 is disposed at the temporarily placed position, the sponge material 168 attached to the wall surface 166*a* is in contact with the opening/closing member 78 in the container circumferential direction. Thus, the wall surface 166*a* of the recess 166 and the sponge material 168 regulate the rotation of the opening/closing member 78 to the one side in the container circumferential direction.

Furthermore, the releasing projection 162 enters the through hole 142 formed in the opening/closing member 78 so as to push upward the limiting portion 98 of the lid portion 68. As a result, as indicated by the solid line illustrated in FIG. 21, the limiting portion 98 is elastically deformed so as to release the engagement between the protrusion 140 formed in the opening/closing member 78 and the recess 98*a* of the limiting portion 98 (see FIG. 21).

Furthermore, when the gripping portion 74 is gripped and the container 60 disposed at the temporarily placed position is rotated to the one side in the container circumferential direction, as illustrated in FIG. 26B, the projection 216*a* and the extended surface 72*d* are separated from each other in the container circumferential direction, thereby the holding portion 216 is elastically returned to its original shape. In this state, when the projection 216*a* of the holding portion 216 covers, from above, the portion of the lid portion 68 where the extended surface 72*d* is formed, the holding portion 216 holds the container 60 disposed at the mounted position.

Furthermore, when the container 60 disposed at the temporarily placed position is rotated to the one side in the container circumferential direction, as illustrated in FIG. 25, the opening/closing member 174 is pushed to the one side in the container circumferential direction by the end surface of the step portion 72*b* formed in the lid portion 68, thereby the opening/closing member 174 is moved from the closed position to the open position. Furthermore, as illustrated in FIG. 20, since the rotation of the opening/closing member 78 to the one side in the container circumferential direction is regulated by the sponge material 168 and the wall surface 166*a*, the opening/closing member 78 is moved from the closed position to the open position. Thus, as illustrated in FIG. 25, the opening 72*c* formed in the lid portion 68 and the opening 202 formed in the container mounting portion 82 face each other.

An angle by which the container 60 is rotated is regulated by a stopper (not illustrated). Thus, the container 60 is disposed at the mounted position. As illustrated in FIG. 4, in the state in which the container 60 is disposed at the mounted position, the mark 112*a* of the container 60 and the mark 172*b* of the container mounting portion 82 face each other in the apparatus depth direction.

Furthermore, as illustrated in FIG. 23, in the state in which the container 60 is disposed at the mounted position, the contact surface 104 of the lid portion 68 is in contact with the contact surface 182 of the container mounting portion 82 from inside in the container radial direction. Furthermore, the contact surface 102 of the lid portion 68 is in contact with the contact surface 186 of the container mounting portion 82 from inside in the container radial direction. Furthermore, as illustrated in FIG. 24, the contact surface 106 of the lid portion 68 is in contact with the contact surface 196 of the container mounting portion 82 from outside in the container radial direction.

Furthermore, the transmitting portion 212 of the container mounting portion 82 (see FIG. 15) projects through the circular hole 210. Thus, the transmitting portion 212 is brought into engagement with the transmitting portion 88 of the container 60 (see FIG. 8). In this way, the transmitting portion 212 rotated by the motor (not illustrated) transmits the rotating force to the transmitting portion 88.

Thus, the container portion 62 of the container 60 disposed at the mounted position illustrated in FIG. 4 is rotated in the container circumferential direction. This causes the toner contained in the container portion 62 to be pushed by the projection 66 projecting from the inner circumferential surface 62*c* of the container portion 62 (see FIG. 12). Thus, the toner is moved from the rear part to the front part in the apparatus depth direction. The toner having been moved to the front part in the apparatus depth direction is supplied to the developing device 40 through the opening 72*c* formed in the lid portion 68 and the opening 202 formed in the container mounting portion 82 illustrated in FIG. 25.

In order to remove the container 60 from the container mounting portion 82 formed in the unit body 80, the gripping portion 74 is gripped and the container 60 disposed at the mounted position is rotated to the other side in the container circumferential direction. When the container 60 is rotated to the other side in the container circumferential direction, as illustrated in FIG. 26A, the extended surface 72*d* of the lid portion 68 is brought into contact with the projection 216*a* of the holding portion 216. This causes the holding portion 216 to be bent and elastically deformed about the base end portion.

Furthermore, even when the container 60 is rotated to the other side in the container circumferential direction, as illustrated in FIG. 19, the rotation of the opening/closing member 78 to the other side in the container circumferential direction is blocked by the inhibiting portion 160. Accordingly, the regulating projections 96 formed in the lid portion 68 push the inhibiting portion 160 of the container mounting portion 82 with the suppressing plate 150 of the opening/closing member 78 interposed therebetween so as to regulate the angle by which the container 60 is rotated. Thus, the container 60 is moved to the temporarily placed position.

Thus, when the lid portion 68 is moved relative to the opening/closing member 78, the opening/closing member 78 disposed at the open position is moved to the closed position. Furthermore, the opening/closing member 174 is pushed to the other side in the container circumferential direction by a projection (not illustrated) formed in the lid portion 68, thereby the opening/closing member 174 is moved from the open position to the closed position.

Furthermore, as indicated by the two-dot chain line and the solid line illustrated in FIG. 18, when the container 60 is moved upward while the guide surface 108 of the container 60 being in contact with the intersecting surface 180 of the container mounting portion 82, the container 60 is removed from the container mounting portion 82.

Furthermore, when the container 60 is moved upward from the temporarily placed position, the releasing projection 162 illustrated in FIG. 20 is separated from the limiting portion 98 of the lid portion 68, thereby the limiting portion 98 is elastically returned to its original shape. When the limiting portion 98 is elastically returned to its original shape, as indicated by the two-dot chain line illustrated in FIG. 21, the recess 98*a* of the limiting portion 98 is brought into engagement with the protrusion 140 of the opening/closing member 78. Thus, the state in which the opening/closing member 78 is disposed at the closed position is maintained.

Next, the case where the user disposes the container 60, 560 at a position deviated from the temporarily placed position is described. First, the case where the user disposes the container 560 at a position deviated from the temporarily placed position is described.

Figure 29:
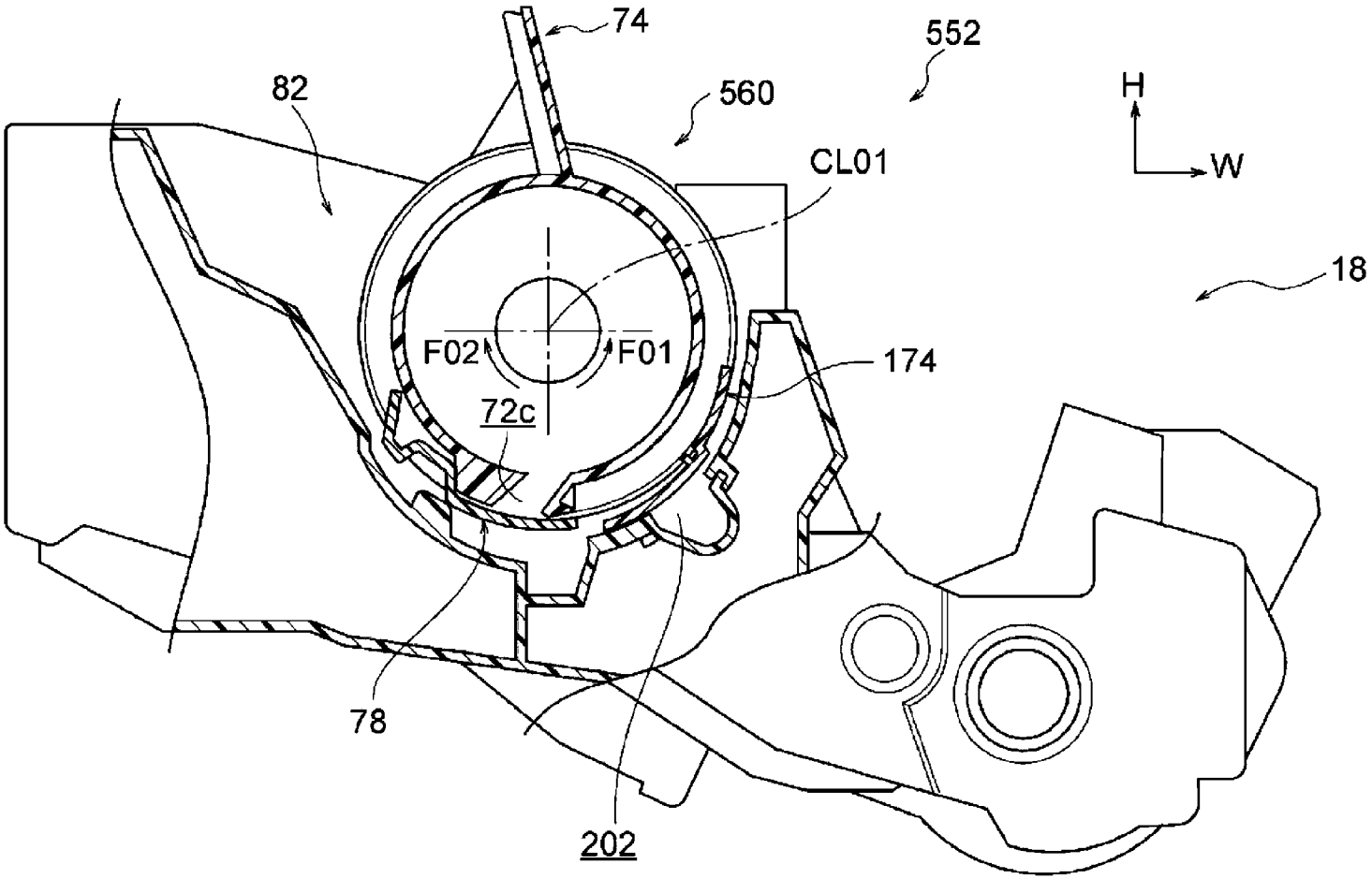
FIG. 29 is a sectional view illustrating a state in which a container is disposed at a position deviated from a temporarily placed position in a container mounting structure according to a comparative embodiment compared to the exemplary embodiment of the present disclosure.

In some case, the container 560 is disposed at a position above the temporarily placed position as illustrated in FIG. 29 when the extended surface 72*d* (see FIG. 8) of the second cylindrical portion 72 of the container 560 provided in the container mounting structure 552 is brought into contact with the projection 216*a* of the holding portion 216 illustrated in FIG. 17. That is, in some cases, the container 560 floats above the temporarily placed position and is disposed at a position deviated from the temporarily placed position. In this state, the engagement between the recess 98*a* of the limiting portion 98 and the protrusion 140 illustrated in FIG. 21 is not released.

Figure 30:
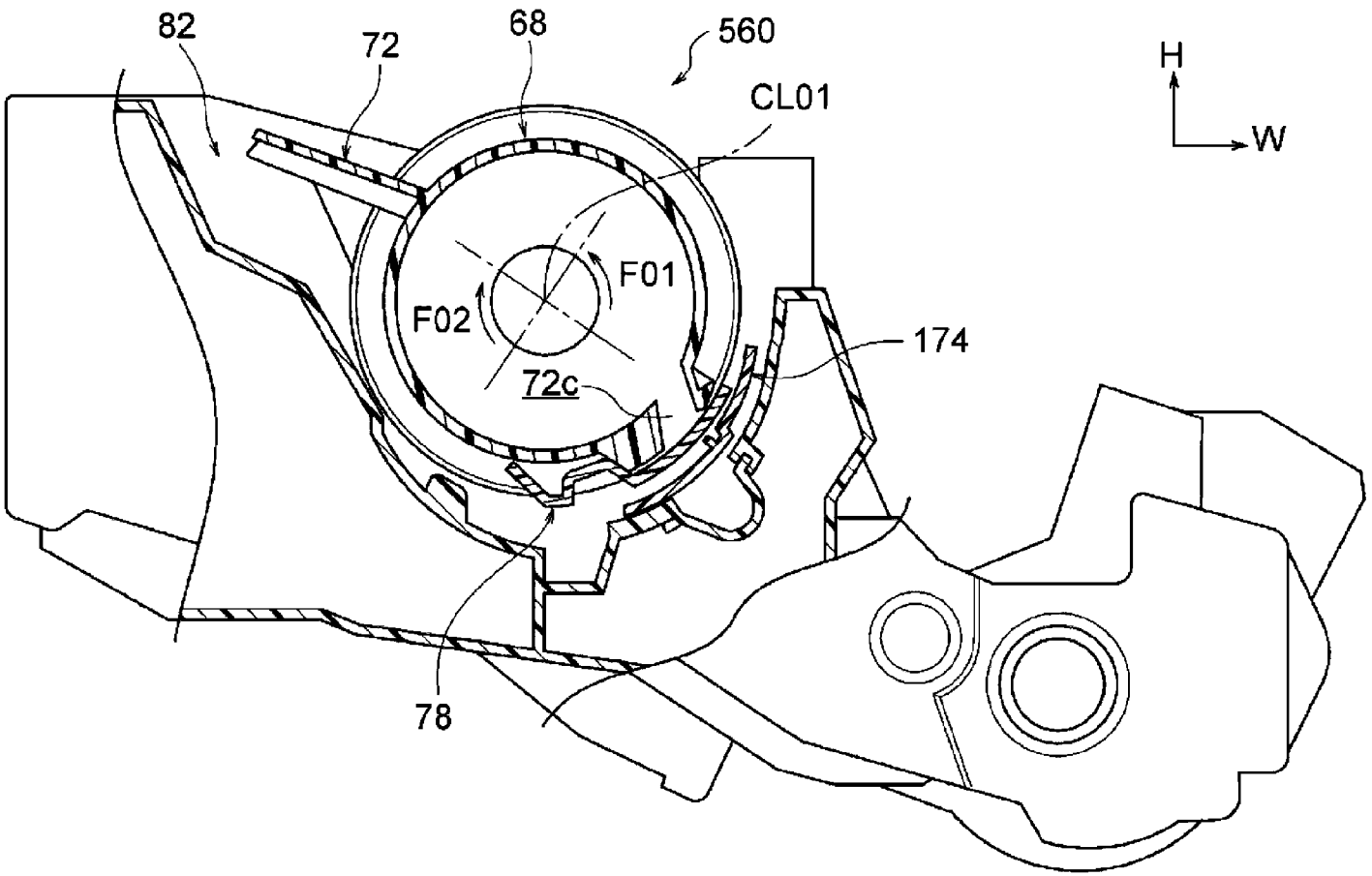
FIG. 30 is a sectional view illustrating a state in which the container is disposed at a position deviated from the temporarily placed position in the container mounting structure according to the comparative embodiment compared to the exemplary embodiment of the present disclosure.

It is assumed that, without noticing the fact that the container 560 has been disposed at a position deviated from the temporarily placed position, the user grips the gripping portion 74 and, in this state, rotates the container 560 to the one side in the container circumferential direction. This causes, as illustrated in FIG. 30, the opening/closing member 78 to rotate to the one side in the container circumferential direction while closing the opening 72*c* formed in the lid portion 68.

As described above, despite the fact that the opening 72*c* formed in the lid portion 68 is closed by the opening/closing member 78, the user may incorrectly recognize that the container 560 is mounted to the container mounting portion 82 because the mark 112*a* of the container 560 and the mark 172*b* of the container mounting portion 82 face each other in the apparatus depth direction. That is, despite the fact that the opening 72*c* is incompletely exposed, the user may incorrectly recognize that the container 560 has been mounted to the container mounting portion 82. Here, the state in which the opening 72*c* is incompletely exposed refers to a state in which the opening 72*c* is not entirely exposed.

Figure 27:
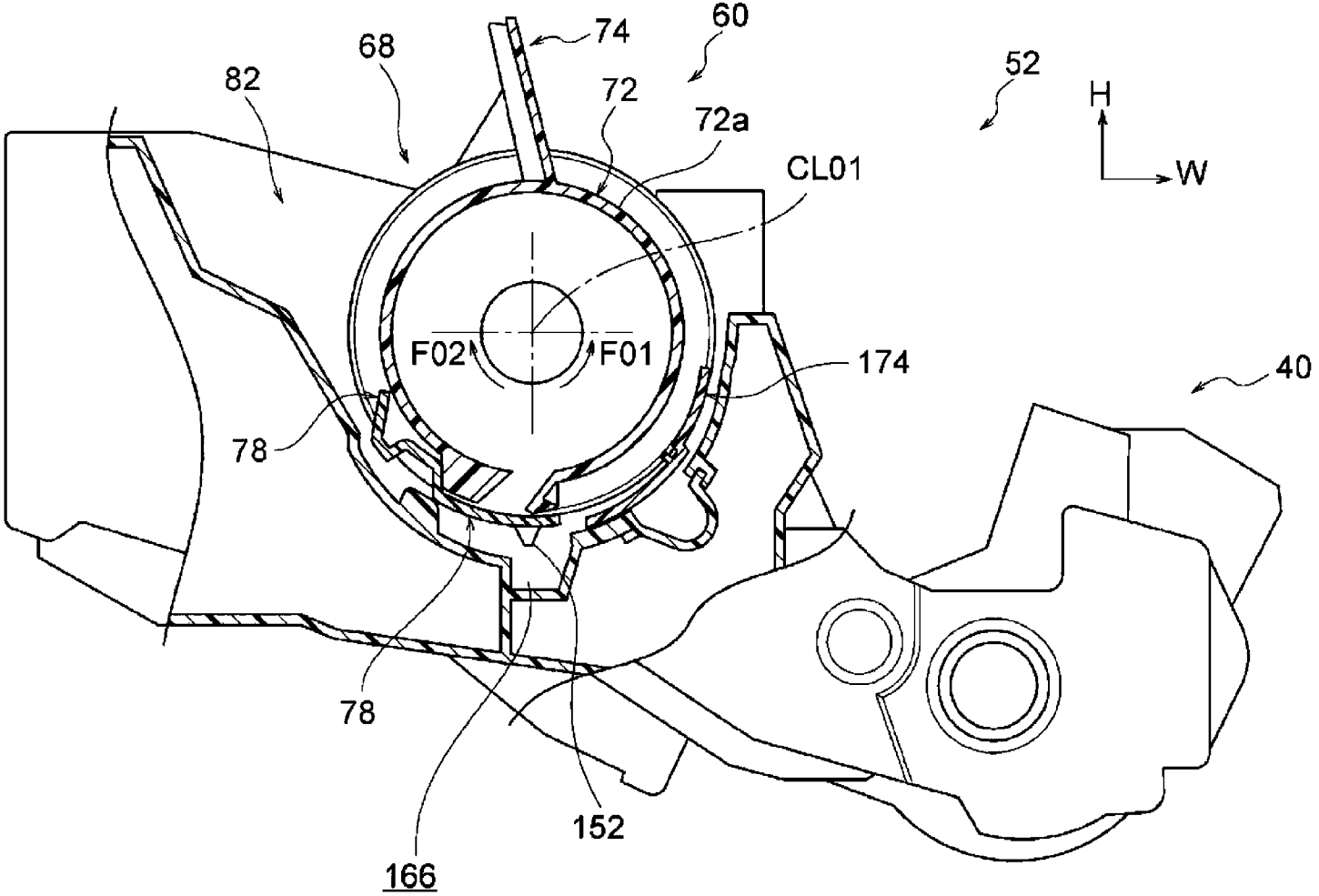
FIG. 27 is a sectional view illustrating the state in which the container is disposed at a position deviated from the temporarily placed position in the container mounting structure according to the exemplary embodiment of the present disclosure.

Also, in some cases, the container 60 is disposed at a position above the temporarily placed position as illustrated in FIG. 27 when the extended surface 72*d* (see FIG. 8) of the second cylindrical portion 72 of the container 60 provided in the container mounting structure 52 according to the present exemplary embodiment is brought into contact with the projection 216*a* of the holding portion 216 illustrated in FIG. 17. That is, in some cases, the container 60 floats above the temporarily placed position and is disposed at a position deviated from the temporarily placed position. In this state, the engagement between the recess 98*a* of the limiting portion 98 and the protrusion 140 illustrated in FIG. 21 is not released.

It is assumed that, without noticing the fact that the container 60 has been disposed at a position deviated from the temporarily placed position, the user grips the gripping portion 74 and, in this state, rotates the container 60 to the one side in the container circumferential direction. As a result, as illustrated in FIG. 28, the regulating projections 152 of the opening/closing member 78 push the sponge material 168 attached to the wall surface 166*a* of the recess 166. In this way, the wall surface 166*a* of the recess 166 and the sponge material 168 regulate the movement of the opening/closing member 78 to the one side in the container circumferential direction. That is, a state in which the mark 112*a* of the container 60 and the mark 172*a* of the container mounting portion 82 face each other in the apparatus depth direction is maintained.

Thus, the user notices the fact that the container 60 has been disposed at a position deviated from the temporarily placed position. Accordingly, the user corrects the position of the container 60 so as to dispose the container 60 at the temporarily placed position and performs the above-described work.

Summarization

As described above, in the container mounting structure 552, when the container 560 is rotated to the one side in the container circumferential direction while the container 560 is disposed at a position deviated from the temporarily placed position, the container 560 is rotated to the one side in the container circumferential direction while the opening/closing member 78 closes the opening 72*c*. Thus, despite the fact that the opening 72*c* is incompletely exposed, the user may incorrectly recognize that the container 560 has been mounted to the container mounting portion 82.

In contrast, in the container mounting structure 52, when the container 60 is rotated to the one side in the container circumferential direction while the container 60 is disposed at a position deviated from the temporarily placed position, the regulating projections 152 push the sponge material 168 attached to the wall surface 166*a*. This regulates the rotation of the container 60 to the one side in the container circumferential direction, and accordingly, the user notices the fact that the container 60 has been disposed at a position deviated from the temporarily placed position. Thus, with the container mounting structure 52, compared to the case where even the container disposed at a position deviated from the temporarily placed position is rotated in the circumferential direction such as a case with the container 560, the likelihood of incomplete exposure of the opening 72*c* may be reduced.

Furthermore, in the container mounting structure 52, the regulating projections 152 push the sponge material 168 attached to the wall surface 166*a*, thereby the rotation of the container 60 is regulated. Thus, the rotation of the container 60 may be regulated with a simpler structure than in the case where, for example, the rotation of the container 60 is electrically regulated.

Furthermore, in the container mounting structure 52, the container 60 is moved downward from above so as to be disposed at the temporarily placed position. Furthermore, the regulating projections 152 project downward (in the direction in which the container 60 is moved) from the lid portion 68. Thus, compared to the case where the regulating projections project in a direction perpendicular to the moving direction of the container, the likelihood of the movement of the container 60 being obstructed by the regulating projections may be reduced.

Furthermore, in the container mounting structure 52, when seen in the apparatus depth direction, the regulating projections 152 project in the opposite direction to the direction in which the gripping portion 74 projects. Thus, when seen in the apparatus depth direction, the section of a packing carton for packing the container 60 may be reduced by disposing the gripping portion 74 and the regulating projections 152 along the diagonal of the packing carton having a rectangular sectional shape compared to the case where the regulating projections project in a direction inclined by 45 degrees from the projecting direction of the gripping portion 74.

Furthermore, in the container mounting structure 52, the wall surface 166*a* and the sponge material 168 form the blocking section 124 that blocks the rotation of the opening/closing member 78 to the one side in the container circumferential direction in the state in which the container 60 is disposed at the temporarily placed position. Also, the wall surface 166*a* and the sponge material 168 form the engagement section 154 that is pushed by the regulating projections 152 when the container 60 is rotated to the one side in the container circumferential direction in the state in which the container 60 is disposed at a position deviated from the temporarily placed position. Thus, the blocking section 124 also serves as the engagement section 154. This may simplify the configuration compared to the case where the blocking section and the engagement section are separately provided.

Furthermore, in the container mounting structure 52, the sponge material 168 is separated from the regulating projections 152 in the container circumferential direction in the state in which the container 60 is disposed at the temporarily placed position. Thus, damage to the regulating projections 152 and the sponge material 168 may be suppressed compared to the case where the sponge material is in contact with the regulating projections in the container circumferential direction in the state in which the container 60 is disposed at the temporarily placed position.

Furthermore, the image forming unit 18 includes the container 60 mounted by using the container mounting structure 52. Thus, compared to the case where even the container disposed at a position deviated from the predetermined temporarily placed position is rotated in the circumferential direction, the likelihood of incomplete exposure of the opening 72*c* may be reduced, and accordingly, the occurrences of failure in replenishment of the developing device 40 with the toner may be suppressed.

Furthermore, in the image forming apparatus 10, the image forming unit 18 is removably mountable to the apparatus body 12. Accordingly, the container 60 is mountable to the container mounting portion 82 with the image forming unit 18 removed from the apparatus body.

Furthermore, in the image forming apparatus 10, compared to the case where even the container disposed at a position deviated from the predetermined temporarily placed position is rotated in the circumferential direction, the occurrences of failure in replenishment of the developing device 40 with the toner may be suppressed. Accordingly, the occurrences of problems in quality of output images may be suppressed.

Although the present disclosure has been described in detail with the specific exemplary embodiment, the present disclosure is not limited to this exemplary embodiment. It is obvious to one skilled in the art that various other exemplary embodiments are possible within the scope of the present disclosure. For example, according to the above-described exemplary embodiment, when the container 60 disposed at a position deviated from the temporarily placed position is rotated in the container circumferential direction, the sponge material 168 attached to the wall surface 166*a* is pushed. This regulates the movement of the opening/closing member 78 to the one side in the container circumferential direction. However, for example, electrical control may be used to regulate the rotation of the container disposed at a position deviated from the temporarily placed position in the container circumferential direction.

According to the above-described exemplary embodiment, the regulating projections 152 are formed in the container 60 and the wall surface 166*a* is formed in the container mounting portion 82. However, a recess may be formed in the container and a protrusion to be inserted into the recess may be formed in the container mounting portion.

According to the above-described exemplary embodiment, in the state in which the container 60 is disposed at the temporarily placed position, the sponge material 168 is separated from the regulating projections 152 in the container circumferential direction. However, the sponge material 168 in this state may be in contact with the regulating projections 152 in the container circumferential direction. In this case, in order to suppress damage to the sponge material, for example, it is required to round the corners of the regulating projections.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A container mounting structure comprising:

a container that has an opening, that extends in one direction, and that contains powder;

a container mounting portion to which the container is mounted and with which the opening of the container is caused to be exposed when the container disposed at a predetermined temporarily placed position is rotated in a circumferential direction of the container; and a regulating section that regulates the rotation of the container in the circumferential direction in a case where the container is disposed at a position deviated from the temporarily placed position, wherein the regulating section includes an engagement portion formed in the container, and an engagement section that is formed in the container mounting portion and that is, when the container disposed at the position deviated from the temporarily placed position is rotated in the circumferential direction, brought into engagement with the engagement portion before the opening is exposed.

2. The container mounting structure according to claim 1, wherein the container is disposed from outside to the temporarily placed position when the container is moved in an intersecting direction that intersects the one direction, and wherein the engagement portion is a projection that projects in the intersecting direction when seen in the one direction.

3. The container mounting structure according to claim 2, wherein the container has a gripping portion that projects when seen in the one direction and that is able to be gripped for rotating the container in the circumferential direction, and wherein, when seen in the one direction, the projection projects in an opposite direction to a direction in which the gripping portion projects.

4. The container mounting structure according to claim 1, wherein the container includes an opening/closing member that is movable in the circumferential direction so as to allow the opening to be exposed and close the opening, wherein, before the container is disposed at the temporarily placed position, the movement of the opening/closing member in the circumferential direction is limited, wherein the engagement portion is a projection that projects, when seen in the one direction, from the opening/closing member in an intersecting direction that intersects the one direction, wherein the container mounting portion includes a releasing portion that releases, when the container is disposed at the temporarily placed position, the limitation of the movement of the opening/closing member in the circumferential direction, and a blocking section that is, when the container disposed at the temporarily placed position is rotated in the circumferential direction, brought into contact with the opening/closing member so as to block the movement of the opening/closing member, and wherein the blocking section also serves as the engagement section.

5. The container mounting structure according to claim 2, wherein the container includes an opening/closing member that is movable in the circumferential direction so as to allow the opening to be exposed and close the opening, wherein, before the container is disposed at the temporarily placed position, the movement of the opening/closing member in the circumferential direction is limited, wherein the projection projects from the opening/closing member, wherein the container mounting portion includes a releasing portion that releases, when the container is disposed at the temporarily placed position, the limitation of the movement of the opening/closing member in the circumferential direction, and a blocking section that is, when the container disposed at the temporarily placed position is rotated in the circumferential direction, brought into contact with the opening/closing member so as to block the movement of the opening/closing member, and wherein the blocking section also serves as the engagement section.

6. The container mounting structure according to claim 3, wherein the container includes an opening/closing member that is movable in the circumferential direction so as to allow the opening to be exposed and close the opening, wherein, before the container is disposed at the temporarily placed position, the movement of the opening/closing member in the circumferential direction is limited, wherein the projection projects from the opening/closing member, wherein the container mounting portion includes a releasing portion that releases, when the container is disposed at the temporarily placed position, the limitation of the movement of the opening/closing member in the circumferential direction, and a blocking section that is, when the container disposed at the temporarily placed position is rotated in the circumferential direction, brought into contact with the opening/closing member so as to block the movement of the opening/closing member, and wherein the blocking section also serves as the engagement section.

7. The container mounting structure according to claim 4, wherein, when the container is disposed at the temporarily placed position, the blocking section is kept separated from the projection in the circumferential direction.

8. The container mounting structure according to claim 5, wherein, when the container is disposed at the temporarily placed position, the blocking section is kept separated from the projection in the circumferential direction.

9. The container mounting structure according to claim 6, wherein, when the container is disposed at the temporarily placed position, the blocking section is kept separated from the projection in the circumferential direction.

10. An image forming unit comprising:

an image holding body that holds an electrostatic latent image;

a developing section that develops with toner as the powder the electrostatic latent image on the image holding body so as to obtain a toner image; and the container mounting portion to which the container containing the powder is mounted by using the container mounting structure according to claim 1.

11. An image forming apparatus comprising:

an apparatus body;

the image forming unit according to claim 10 removably mountable to the apparatus body; and a transport section that transports a recording medium to which the toner image formed on the image holding body of the image forming unit is transferred.

12. An image forming apparatus comprising:

an image holding body that holds an electrostatic latent image;

a developing section that develops with toner as the powder the electrostatic latent image on the image holding body so as to obtain a toner image;

the container that is mounted by using the container mounting structure according to claim 1 and that contains the powder to be supplied to the developing section; and a transport section that transports a recording medium to which the toner image formed on the image holding body is transferred.

* * * * *